US006126236A

United States Patent [19]

Wu

[11] Patent Number: 6,126,236

[45] Date of Patent: Oct. 3, 2000

[54] MULTI-FUNCTIONAL BABY HIGH CHAIR

[76] Inventor: Sung-Tsun Wu, 8F-1, No. 249, Chung-Ching Road, Pan Chiao City, Taipei Hsien, Taiwan

[21] Appl. No.: 09/433,793

[22] Filed: Nov. 3, 1999

[51] Int. Cl.[7] ..... A47C 1/02

[52] U.S. Cl. ..... 297/325; 297/344.18; 297/423.38; 297/467; 297/148; 297/16.1

[58] Field of Search ..... 297/325, 326, 297/327, 328, 148, 16.1, 30, 24, 25, 423.38, 423.26, 423.4, 451.13, 445.1, 448.1, 452.18, 452.2, 467, 488, 153, 344.12, 344.18

[56] References Cited

U.S. PATENT DOCUMENTS 1,545,269 7/1925 Munroe .
2,691,411 10/1954 Thatcher .
2,705,042 3/1955 Streit .
3,086,812 4/1963 Eads .
3,975,050 8/1976 McKee .
5,507,550 4/1996 Maloney .
5,707,104 1/1998 Perego .

*Primary Examiner*—Milton Nelson, Jr.
*Attorney, Agent, or Firm*—Bacon & Thomas

[57] ABSTRACT

An adjustable baby chair is disclosed. The baby chair has a first locking device; a height adjusting device; a seat adjusting device; a second locking device; and a foot rest. With such an arrangement, the feet of the chair are foldable, the angle, height of the seat are adjustable, the seat is fixed after the baby is seated in the seat and the height of the foot rest is adjustable.

6 Claims, 20 Drawing Sheets

MULTI-FUNCTIONAL BABY HIGH CHAIR

CROSS REFERENCE

Not applicable

BACKGROUND OF THE INVENTION

1. Field of the Invention

The present invention relates to an adjustable baby chair, often referred as "high chair" and, more particularly, to a baby chair which is able to adjust the height of the chair, the reclining angel of the seat and is able to be folded for storage.

2. Description of the Related Article

Baby chairs have been developed for years, its function therefore should be able to meet all kinds of requirements of the end-users, as a result, users can almost purchase any kind of baby chair as required. However, baby chairs available in the current market are mostly single-functional, for example, the entire frame of the baby chair is foldable, the baby chair is moveable or the seating of the chair is adjustable. Beside the safety requirements, users will find it impossible to acquire a high versatile baby chair. For the same reason, users can only choose to copy with the existing available baby chair or to purchase several units of baby chairs with different functions for different purposes, this is often costly and troublesome.

In order to obviate and mitigate the aforementioned problems, the present invention provides an innovative and versatile movable baby chair which allows to adjust the height as well as the reclining angle of the seat, it is also foldable for easy storage.

SUMMARY OF THE INVENTION

The main objective of the invention is to provide a revolutionary adjustable baby chair.

Another objective of the invention is that the height of the chair is able to adjusted freely based on the height of the baby in the seat, so that the baby within a certain height range can sit in the seat comfortably.

Still another objective of the invention is that the reclining angel of the seat of the chair is adjustable in several positions so as to provide the most comfortable angel to the baby at all times.

Other objectives of the invention will be clear after the detailed description of the package with the reference of the accompanying drawings.

BRIEF DESCRIPTION OF THE INVENTION

The present invention will be better understood with the description to the following drawings, wherein.

DETAILED DESCRIPTION OF THE PREFERRED EMBODIMENT

Figure 1:
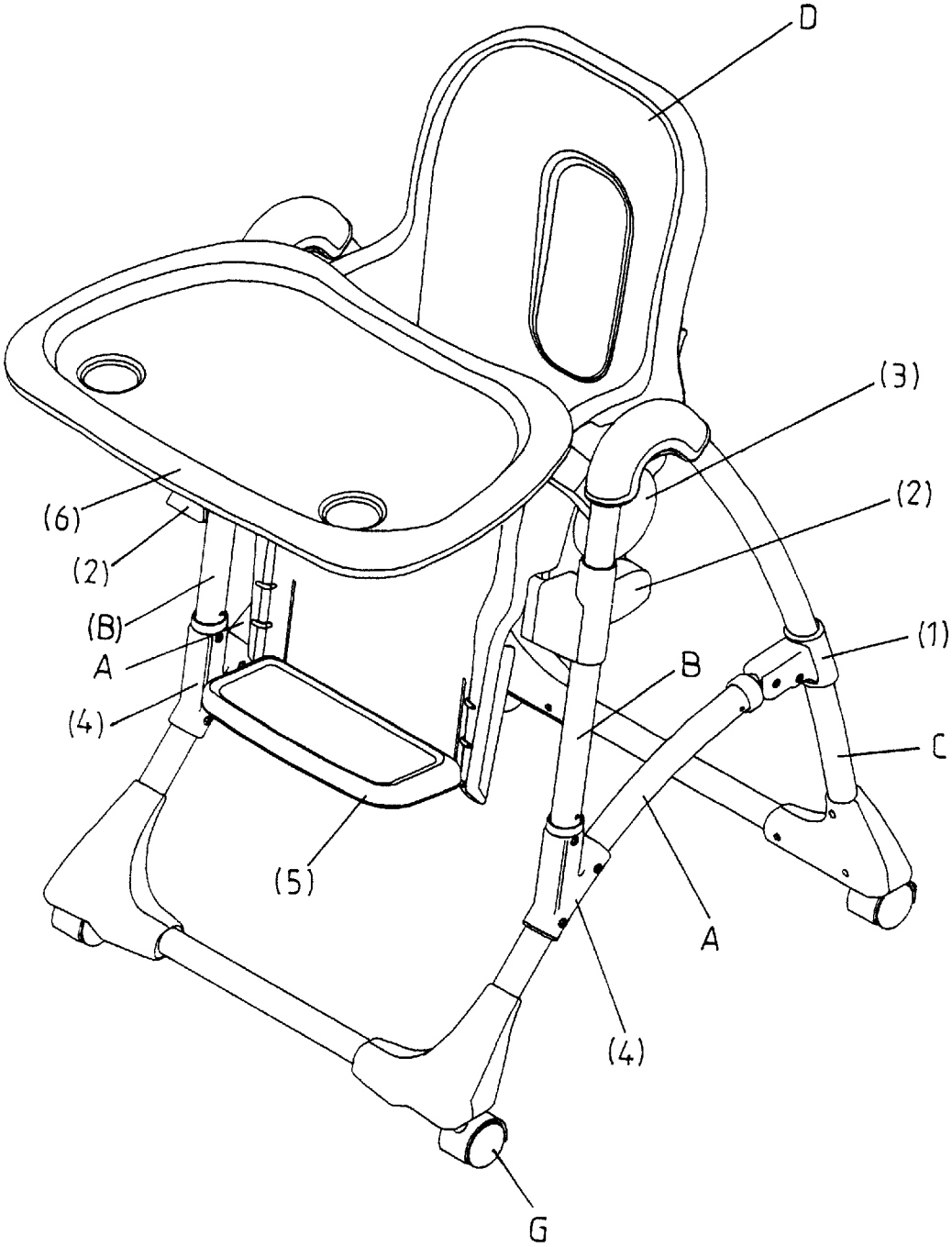
FIG. 1 is a perspective view showing the adjustable chair constructed in accordance with the present invention.

With reference to FIG. 1, the adjustable chair of the invention has a seat (D), a foot mechanism composed of two pairs of legs each pair being oppositely mounted on sides of the chair and having three legs (A,B,C), a foot rest (5), a plate (6) and rollers (9) rotatably mounted on the joint between leg (A) and leg (C). The leg (A) and leg (C) are substantially U shaped and the leg (B) is substantially V shaped. With the leg (B) inverted, the leg (A) and the leg (C) are able to be securely connected with each other and the two ends of leg (B) are then mounted on the joint of leg (A) and leg (C) and a mediate portion of leg (A) respectively. A first locking device (1) is mounted on the joint between the leg (A) and the leg (C).

Figure 3:
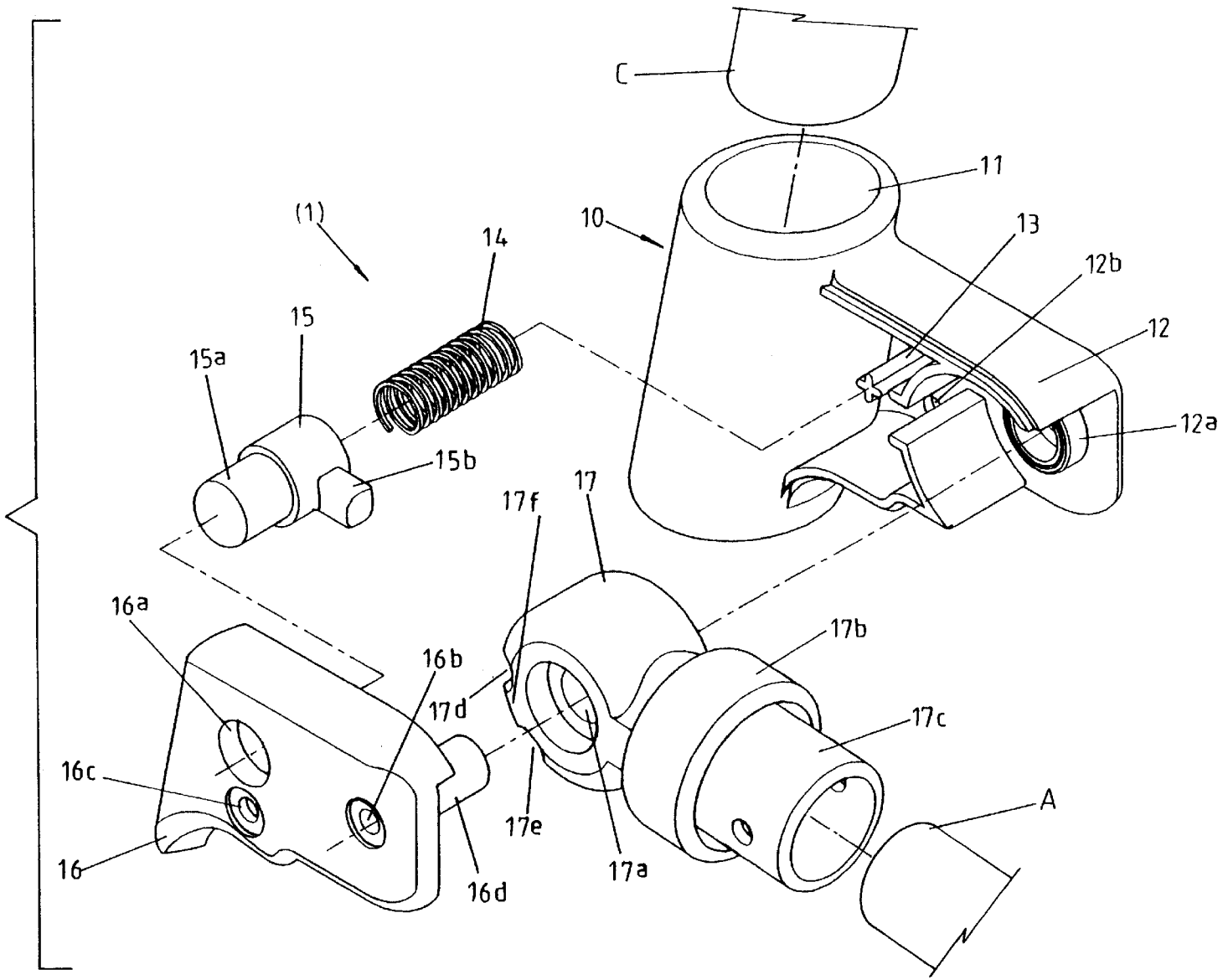
FIG. 3 is an exploded perspective view showing the parts of a first locking device.
Figure 4:
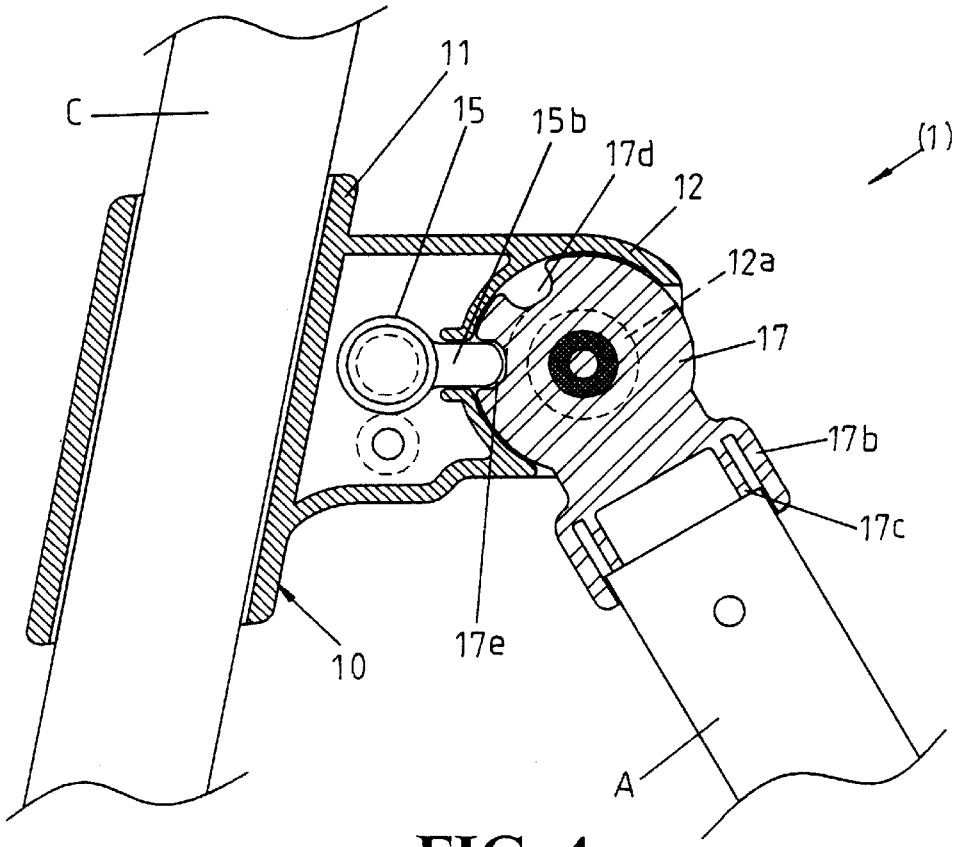
FIG. 4 is a partially cross-sectional view showing the folding of the leg A.
Figure 5:
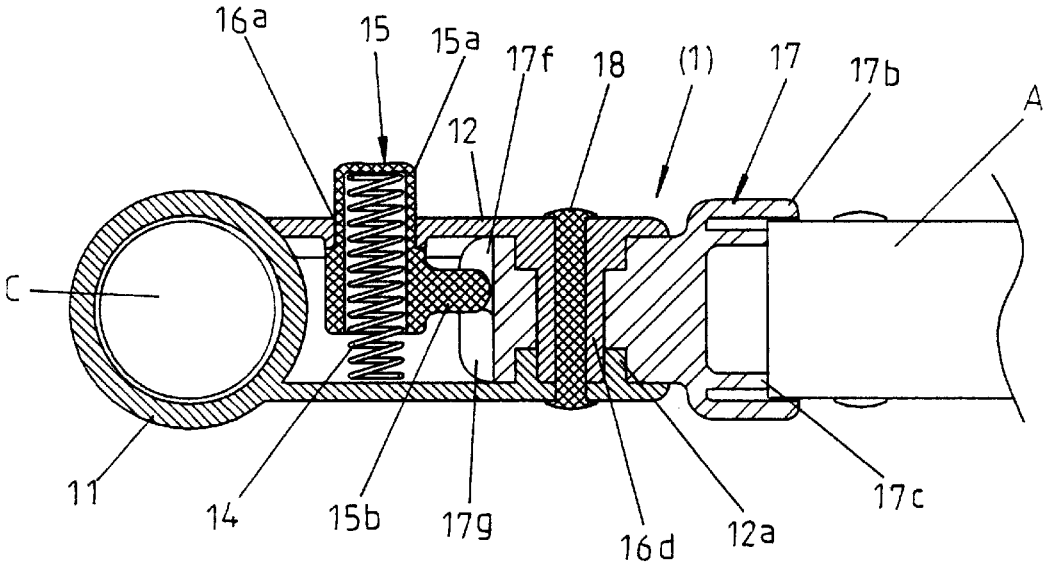
FIGS. 5–9 are partially cross-sectional views showing the movement of the first locking device with the leg A and the leg C.
Figure 6:
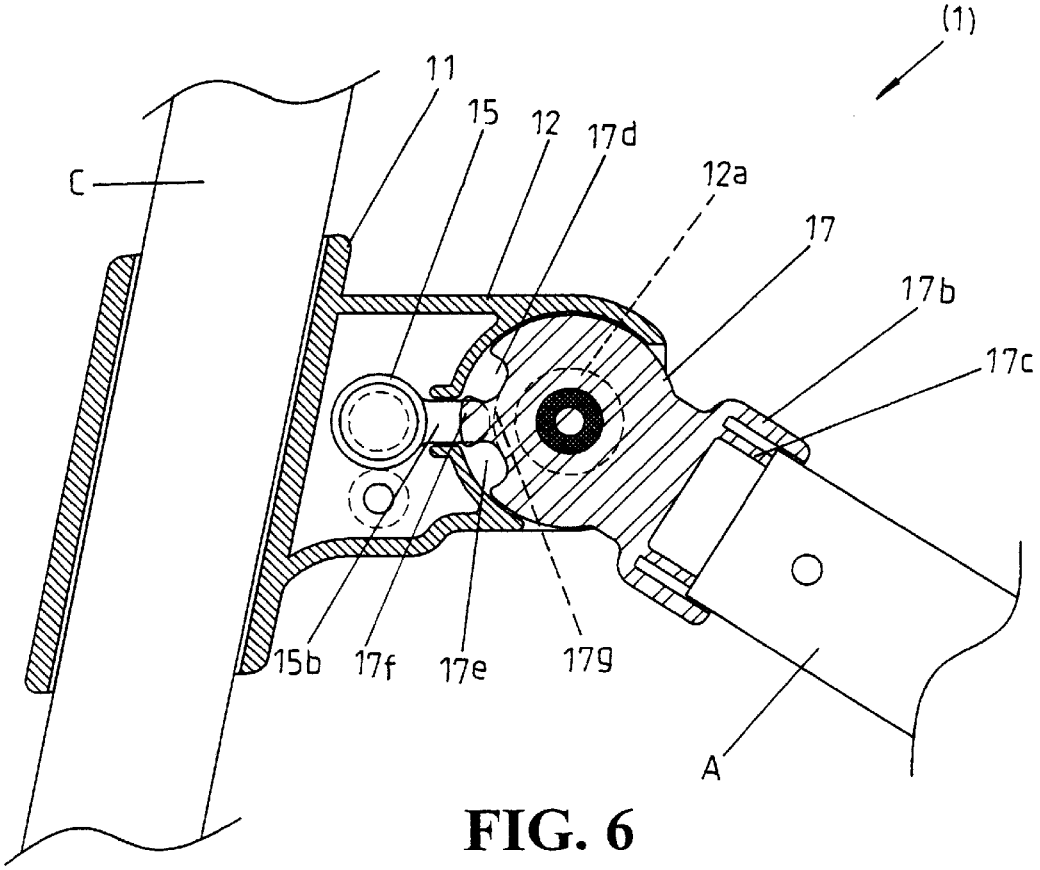
Figure 7:
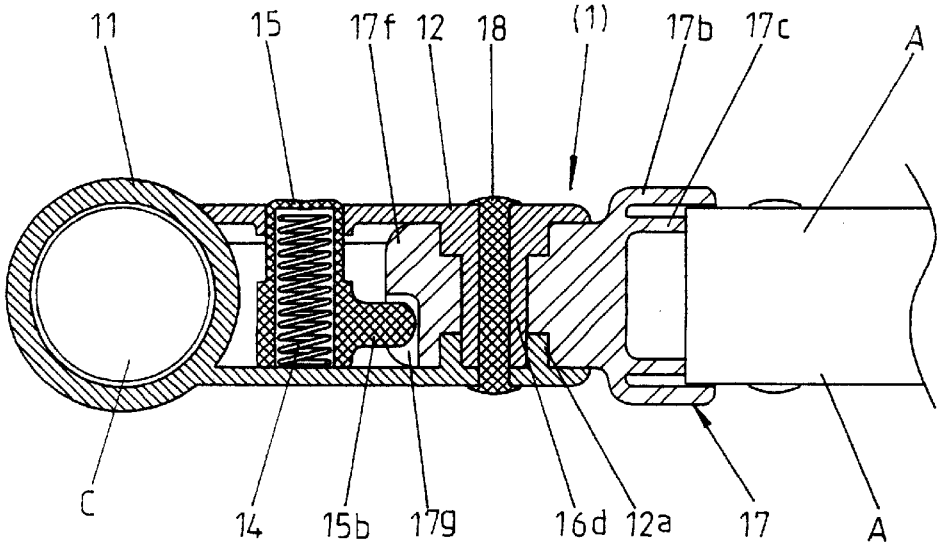

With reference to FIG. 3, the first locking device (1) has a first tubular connector (10) provided with a first tube (11) to receive the leg (C) therein, an L-shaped side cover (12) extending from one side of the first tube (11) and having an elongate rod (13) traversely extending from an inside therefrom, an annular flange (12*a*) formed therein and a first hole (12*b*), a spring (14) to be mounted around the elongate rod (13), a hollow press (15) configured to receive the spring (14) therein and having a button (15*a*) movable with respect to the body of the press (15) and an extension (15*b*) formed on a side of the body of the press (15), a connector (16) having a receiving hole (16*a*) defined to receive the button (15*a*) therethrough after the spring (14) is received in the button (15*a*), a pole (16*b*) extending outside therefrom and having a through hole (16*b*) defined therethrough and a connecting hole (16*c*) defined to correspond to the first hole (12*b*) of the first tubular connector (10) so as to securely connect the connector (16) with the first tubular connector (10) with a locking device, such as a screw (not shown) and a connecting member (17) having a second hole (17*a*) defined to allow the pole (16*d*) to extend therethrough, a first tube (17*b*), a second tube (17*c*) respectively and concentrically formed therewith so as that one end of the leg (A) is able to be received between the gap between the first and the second tubes (17*b*, 17*c*), a first cutout (17*d*), a second cutout (17*e*) respectively and peripherally defined in the outer face defining the second hole (17*a*), a protrusion (17*f*) formed between the first and the second cutouts (17*d*,17*e*) and a space (17*g*) (as shown in FIGS. 5 to 7).

When in assembly, the spring (14) is first received in the button (15*a*) and the button (15*a*) extends through the receiving hole (16*a*). Due to the diameter of the button (15*a*) being smaller than that of the press (15) and the diameter of the press (15) being larger than that of the receiving hole (16*a*), the button (15*a*) is able to be securely abutted against the peripheral edge of the receiving hole (16*c*). After which, the rod (13) extends into the hollow press (15) so as that the spring (14) is mounted around the rod (13). Aligning the connecting hole (16*c*) with the first hole (12*c*) of the first tubular connector (10) and using a screw (not shown) to extend through the aligned first hole (12*c*) and the connecting hole (16*c*), the first tubular connector (10) is able to securely connect the connector (16). Before the engagement of the first tubular connector (10) and the connector (16), the pole (16*d*) extends through the second hole (17*a*) of the connecting member (17) and into the space defined by the annular flange (12*a*). Therefore, a locking device, such as a screw, is able to hold the connecting member (17) between the first tubular connector (10) and the connector (16).

Figure 8:
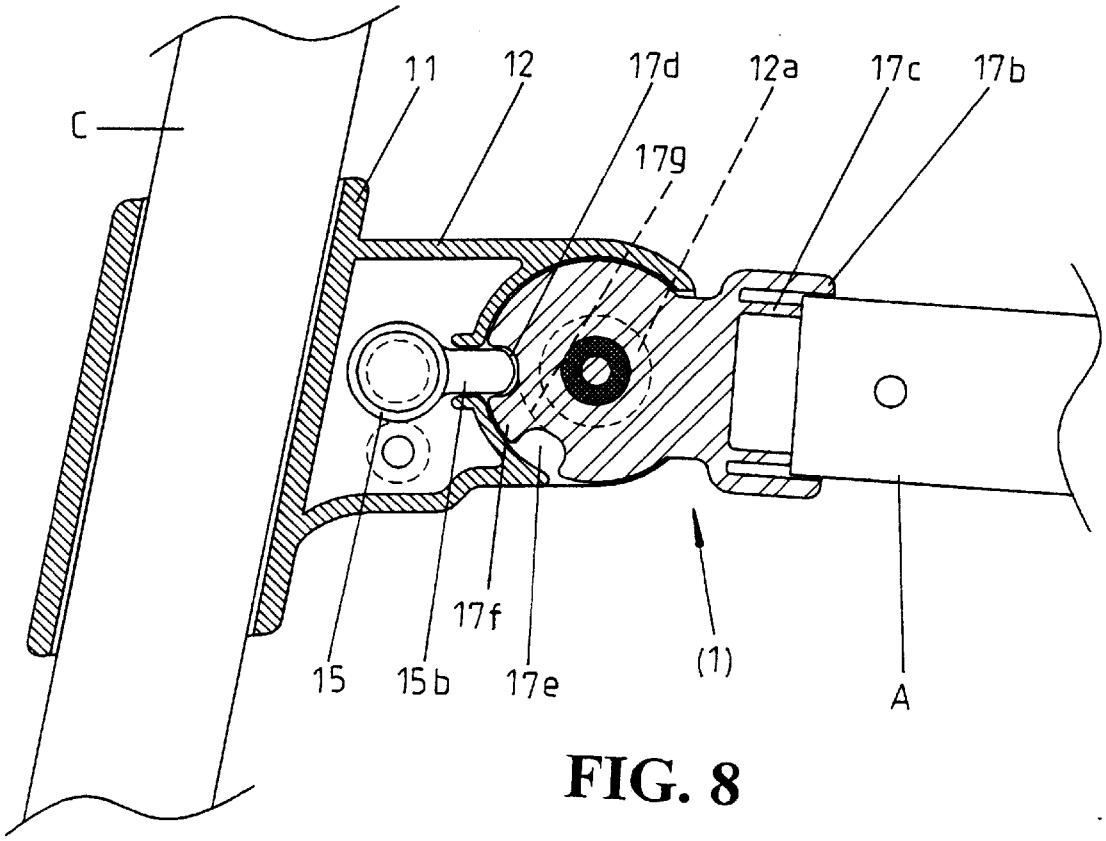
Figure 9:
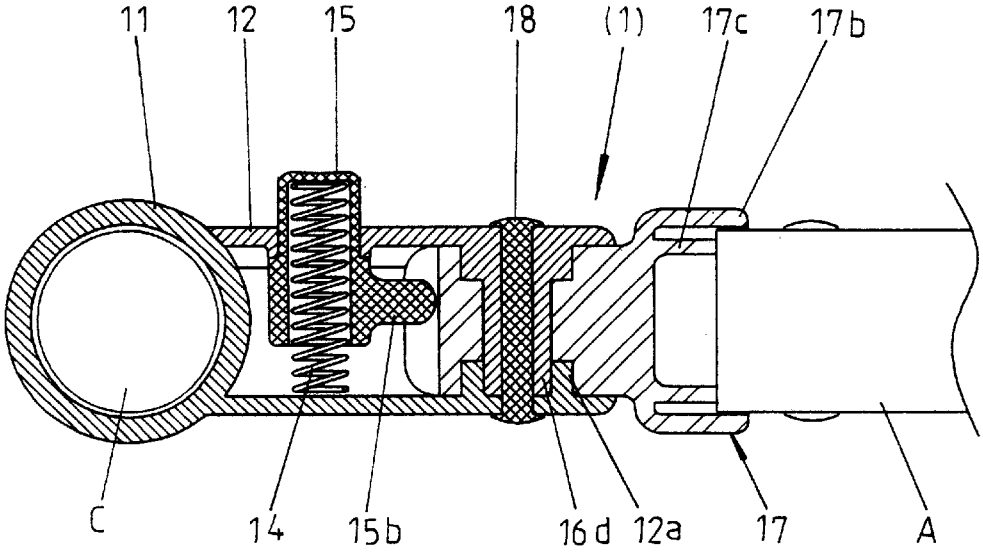
Figure 10:
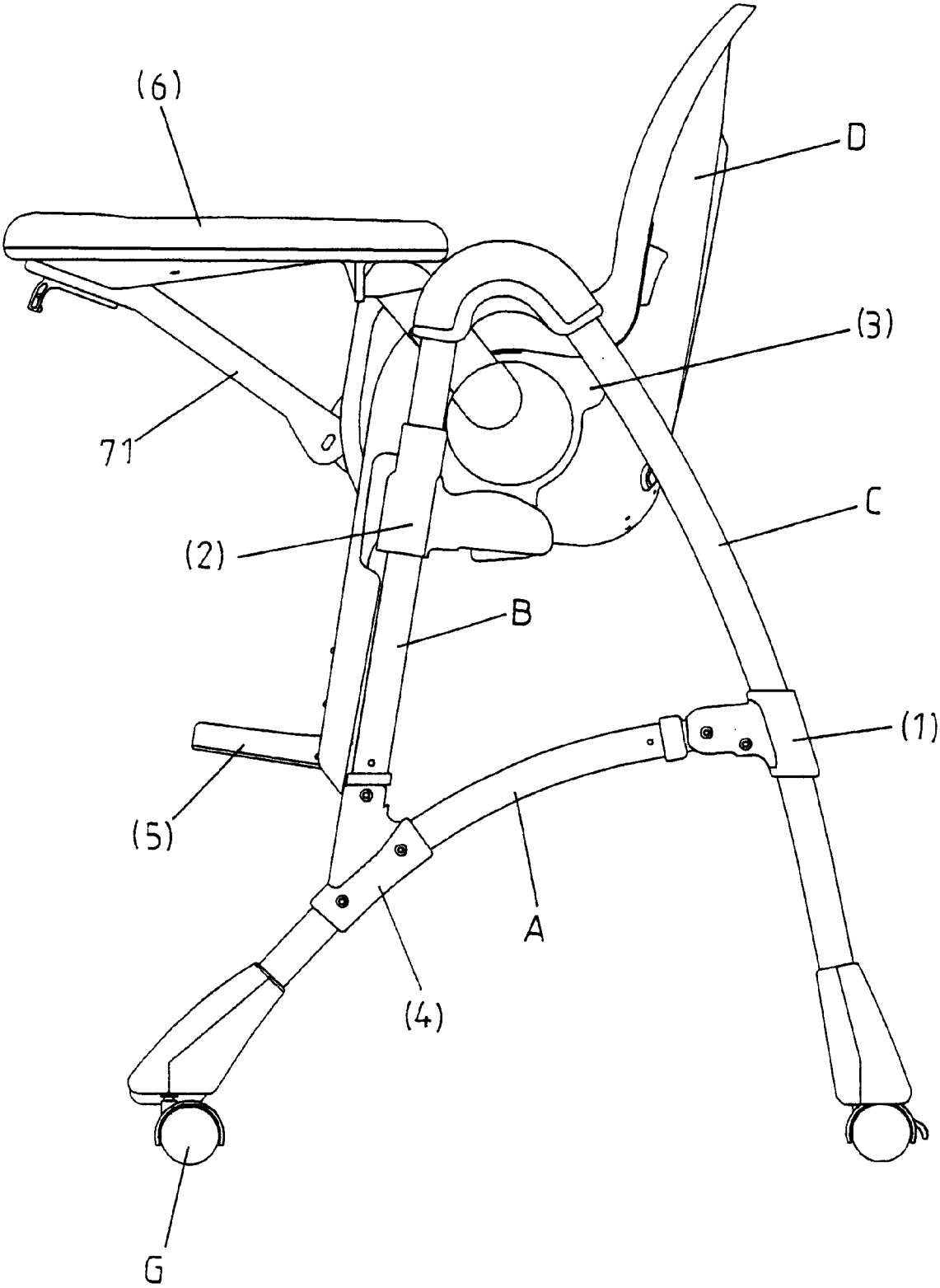
FIG. 10 is a perspective view showing the stretching state of the chair of the invention.
Figure 11:
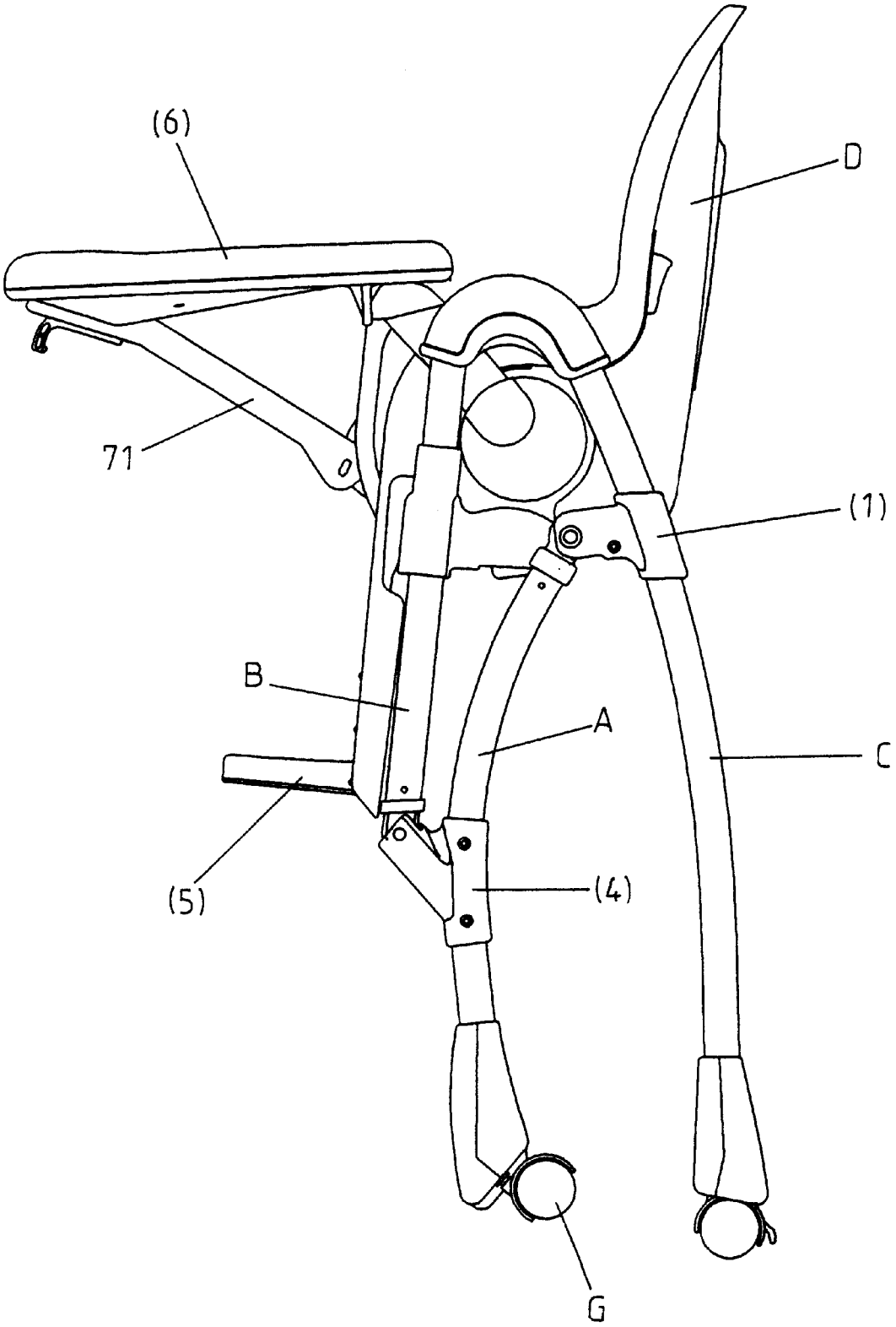
FIG. 11 is a perspective view showing the folded state of the chair of the invention.
Figure 12:
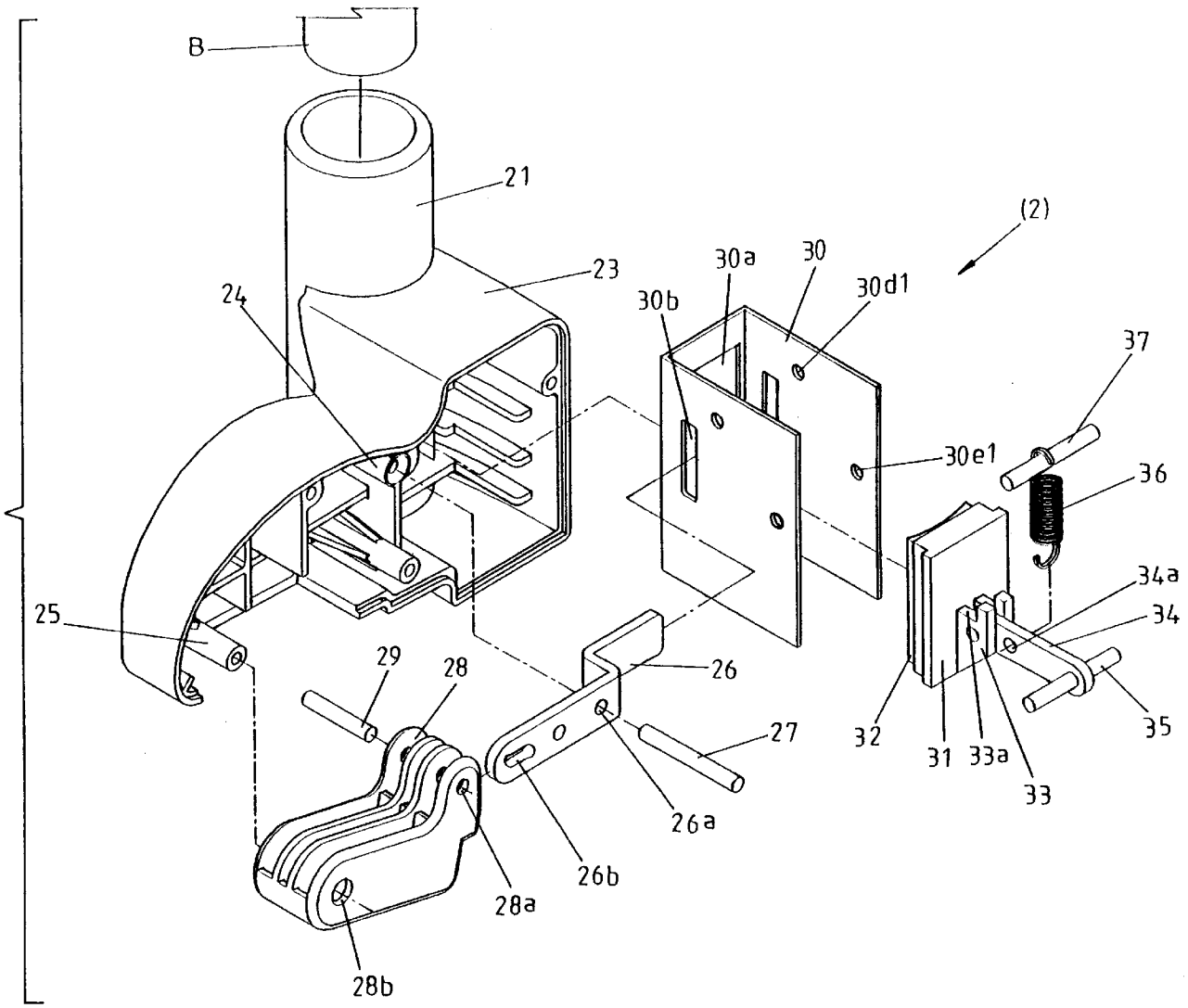
FIG. 12 is an exploded perspective view showing the parts of a height adjusting device.

With reference to FIGS. 4 to 9, when the assembly of the first locking device (1) is completed, it is noted that the extension (15*b*) is received in the space (17*g*) of the connecting member (17). Because the protrusion (17*f*), the extension (15*b*) is not able to move between the first cutout (17*d*) or the second cutout (17*e*). When a user presses the button (15*a*), the extension (15*b*) is released from the limitation of the protrusion (17*f*) and received in the space (17*g*). Without the limitation of the protrusion (17*f*), the extension (15*b*) is thus able to move between the first cutout (17*d*) and the second cutout (17*e*) (as shown in FIGS. 8 and 9), so as that leg (A) and leg (C) are able to change angle with respect to each other. Comparing FIGS. 8 and 9 with FIG. 10, it is to be noted that leg (A) and leg (C) are stretched. Comparing FIGS. 4 and 5 with FIG. 11, it is to be noted that leg (A) and leg (C) are folded in relation to one another.

With reference to FIGS. 12 to 16, a seat adjusting device (2) is mounted at the joint of the seat (D) and leg (B) and has a housing (23) provided with a second tube (21) integrally formed on a side of the housing (23) for receiving a distal end of the leg (B) therein, a hollow extension (24) and a pole (25), a linking member (28) having a plurality of leaves (281) spaced apart from each other and each provided with a concentric hole (28*a*) aligned with one another for receiving a first shaft (29) therein and a through hole (28*b*) defined to receive the pole (25) therein so that the linking member (28) is able to pivot in relation to the housing, a substantially S-shaped linkage (26) having an aperture (26*a*) defined to receive a second shaft (27) therein and an elongate hole (26*b*) defined to receive the first shaft (29) therethrough before the first shaft (29) extends through the entire concentric holes (28*a*) such that the linkage (26) is able to pivot with respect to the linking member (28), a substantially U-shaped member (30) received in the housing (23) and provided with a first opening (30*a*) defined in the sandwiched face, a pair of second opening (30*b*) defined in the opposite faces thereof, a pair of first holes (30*d*1) defined in the opposite faces and a pair of second holes (30*e*1), a first linking member (not numbered) having a base (31), a friction face (32) provided on a side of the base (31) and corresponded to the first opening (30*a*), a seat (33) mounted on opposite face with respect to the friction face (32) and provided with an indentation (33*a*) defined therein and an extension rod (34) extending outward from the seat (33) and having a hole (34*a*) defined in a mediate portion thereof and a traverse rod (35) formed on the distal end of the extension rod (34).

Figure 13:
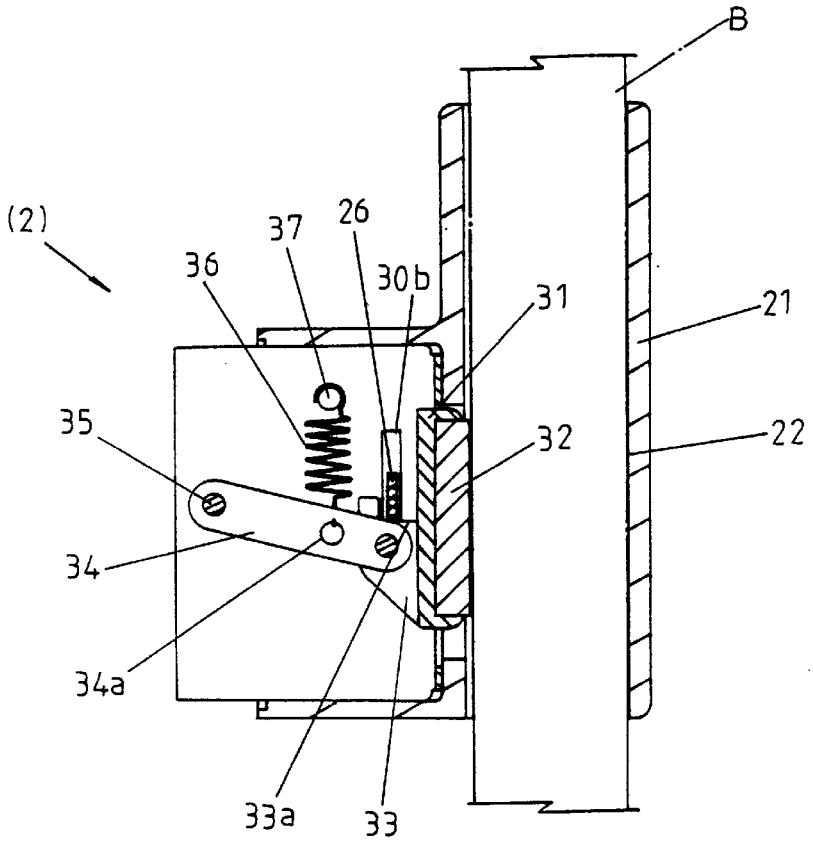
FIG. 13 is a side view showing the assembled height adjusting device.
Figure 14:
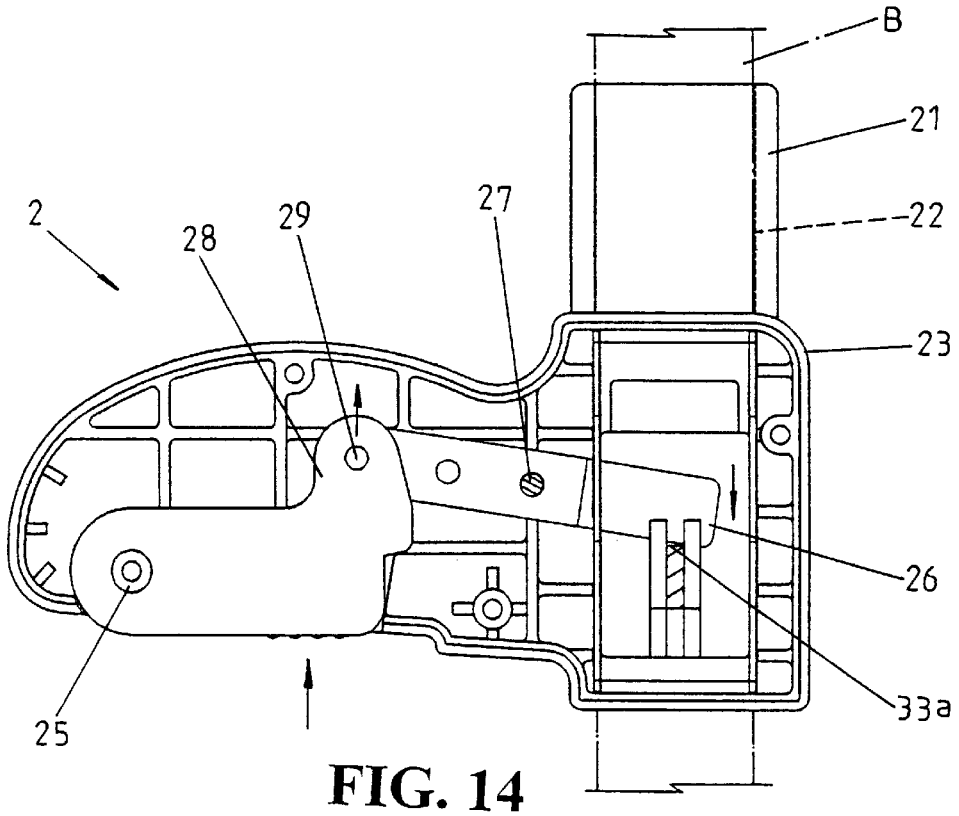
FIG. 14 is a side view showing the assembled height adjusting device from another angle with respect to FIG. 13.
Figure 15:
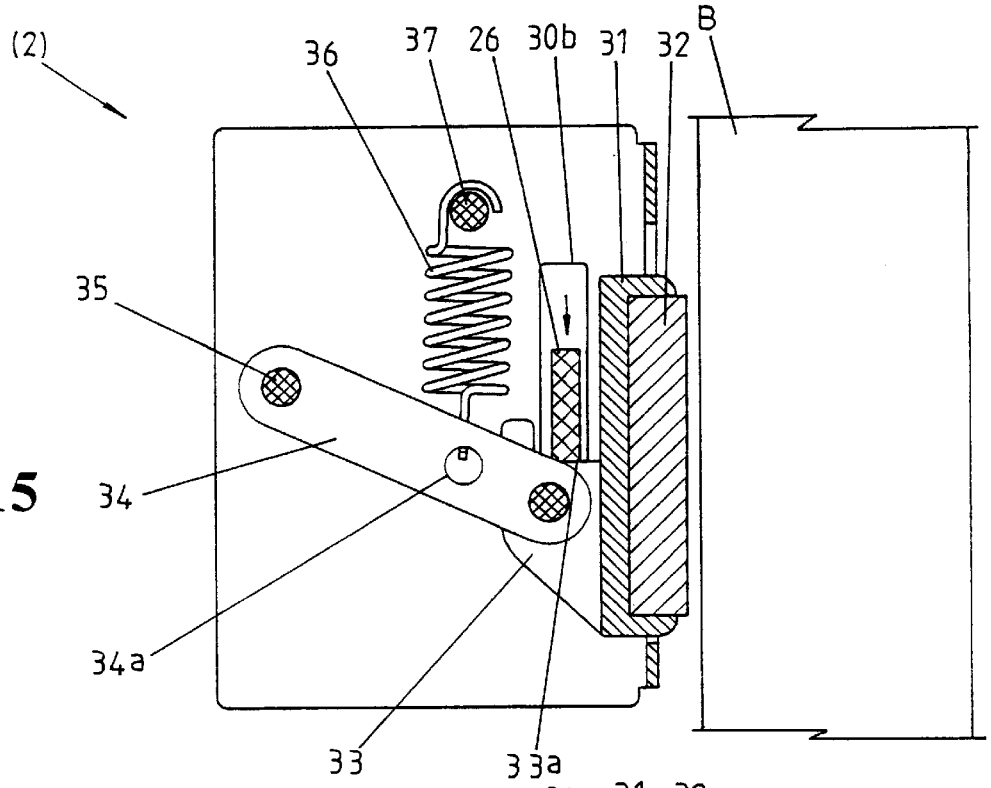
FIGS. 15 and 16 are partially cross-sectional views of the movement of the height adjusting device.
Figure 16:
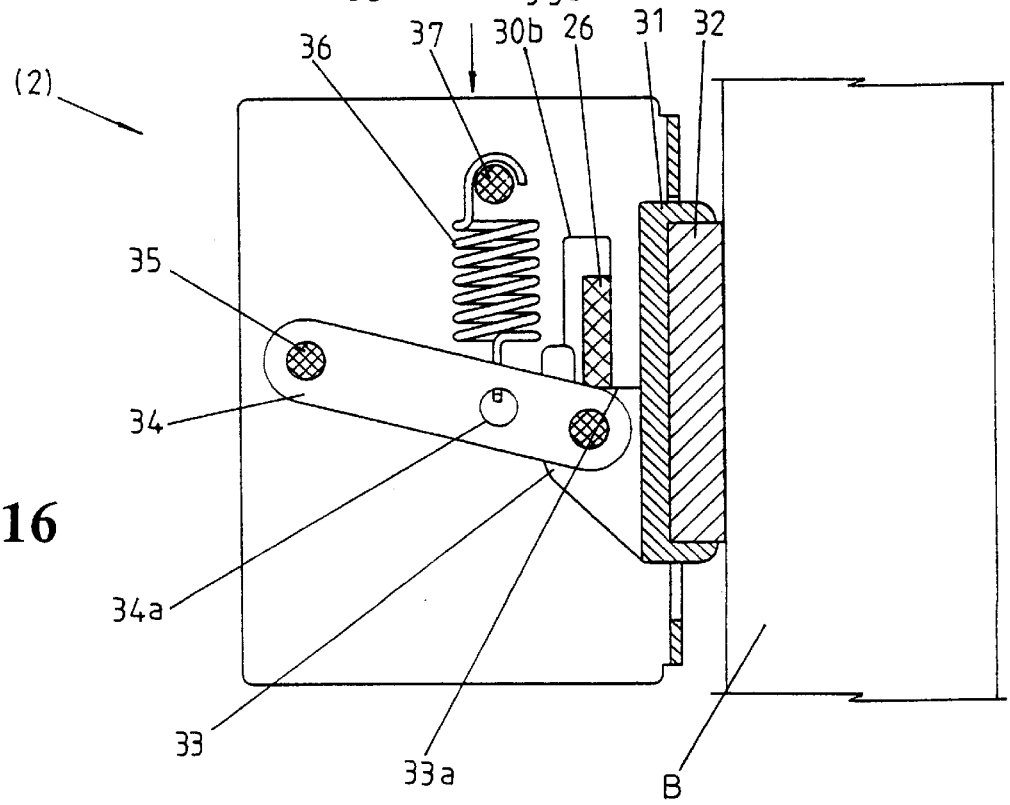

When in assembly, the U-shaped member (30) is first received in the housing (23) to allow the friction face protruding out from the first opening (30*a*) to abut the outer face of the leg (B) which is received in the second tube (21) so as to position the leg (B). The first linking member is pivotally mounted within the U-shaped member (30) by a third shaft (37) securely received between the pair of first holes (30*d*1) and a spring (36) securely connected between the third shaft (37) and the hole (34*a*). Furthermore, the transverse rod (35) is also received between the pair of second holes (30*e*1), such that the first linking member is able to pivot in relation to the U-shaped member (30). One distal end of he linkage (26) is received between the pair of second opening (30*b*) and the bottom face of the portion received between the second openings (30*b*) is received in the indentation (33*a*) of the first linking member. The other distal end of the linkage (26) extends between two adjacent leaves (28*l*) so as to allow the first shaft (29), from the first concentric hole (28*a*), to extend through the elongate hole (26*b*) and into the rest of the concentric holes (28*a*). The pole (25) extends through the through hole (28*b*) and then a locking device, such as a screw, is used to secure the pole (25) with the through hole (28*b*). The second shaft (27) extends through the aperture (26*a*) and into the hollow extension (24) of the housing (23). Therefore, the linkage (26) is able to pivot with respect to the housing (23). With reference to FIGS. 13 to 15, when the bottom of the linking member (28) is lifted upward, one end of the linkage (26) is accordingly lifted upward and because of the second shaft (27), the other end of the linkage (26) is lowered. Because the other end of the linkage (26) is received in the indentation (33*a*) of the first linking member, the first linking member (33*a*) is accordingly pressed downward. Due to the transverse rod (35), the downward movement of the first linking member is moving in an arcuate manner. Actually, the arcuate movement of the first linking member makes the first linking member to move backward in relation to the U-shaped member (30). However, during the movement of the first linking member, the friction face (32) disengages with the outer face of the leg (B), such that the seat (D) is able to adjust the height with respect to the leg (B). When the adjustment of the seat (D) with the leg (B), releasing the bottom of the linking member (28) will allow the recoil force of the stretched spring (36) to have the first linking member to restore its original position and the friction face (32) will again abut the outer face of the leg (B), as shown in FIG. 16.

Figure 17:
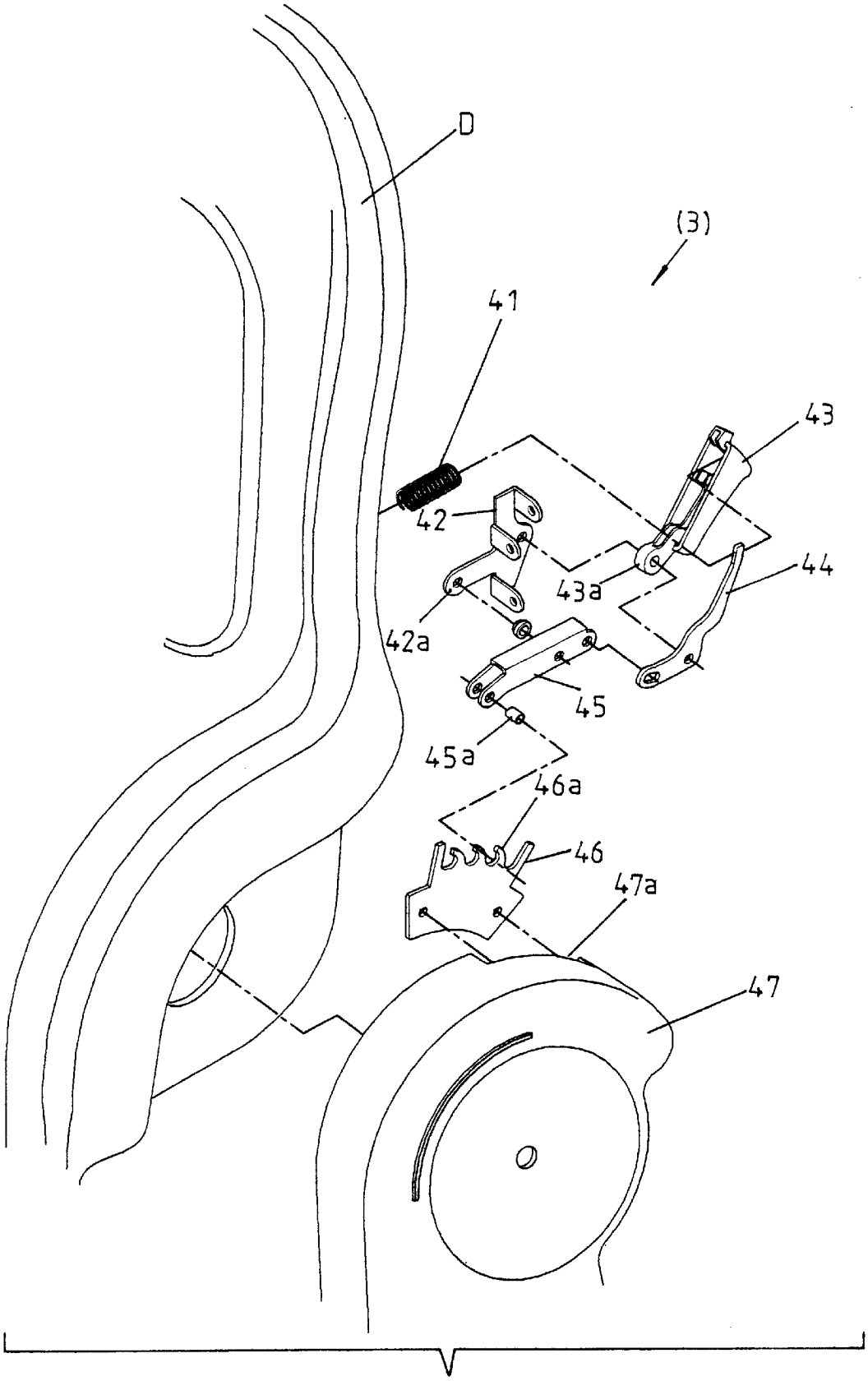
FIG. 17 is an exploded perspective view showing parts of a seat adjusting device of the invention.
Figure 18:
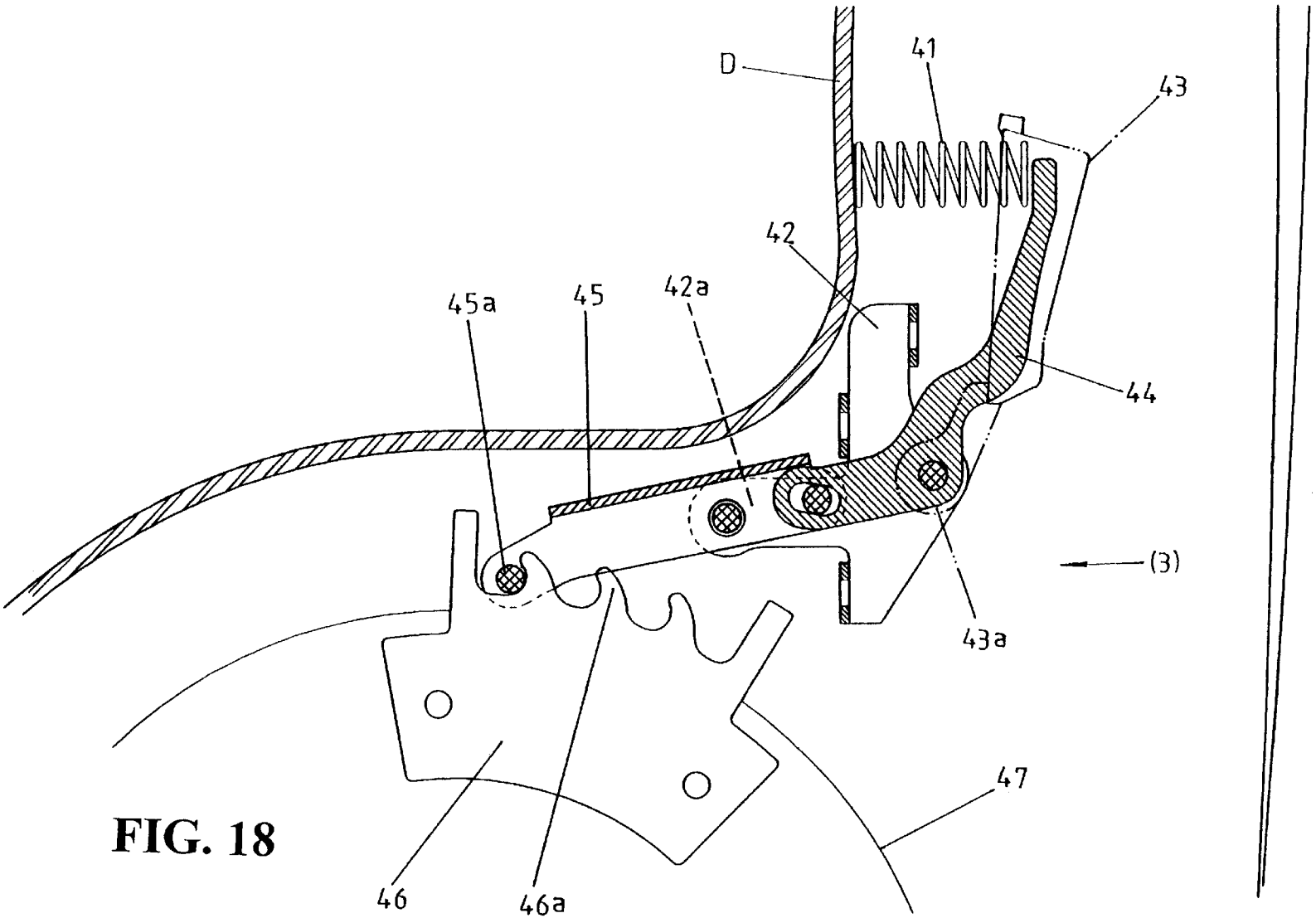
FIG. 18 is a schematic view showing the locked state of the seat adjusting device.
Figure 19:
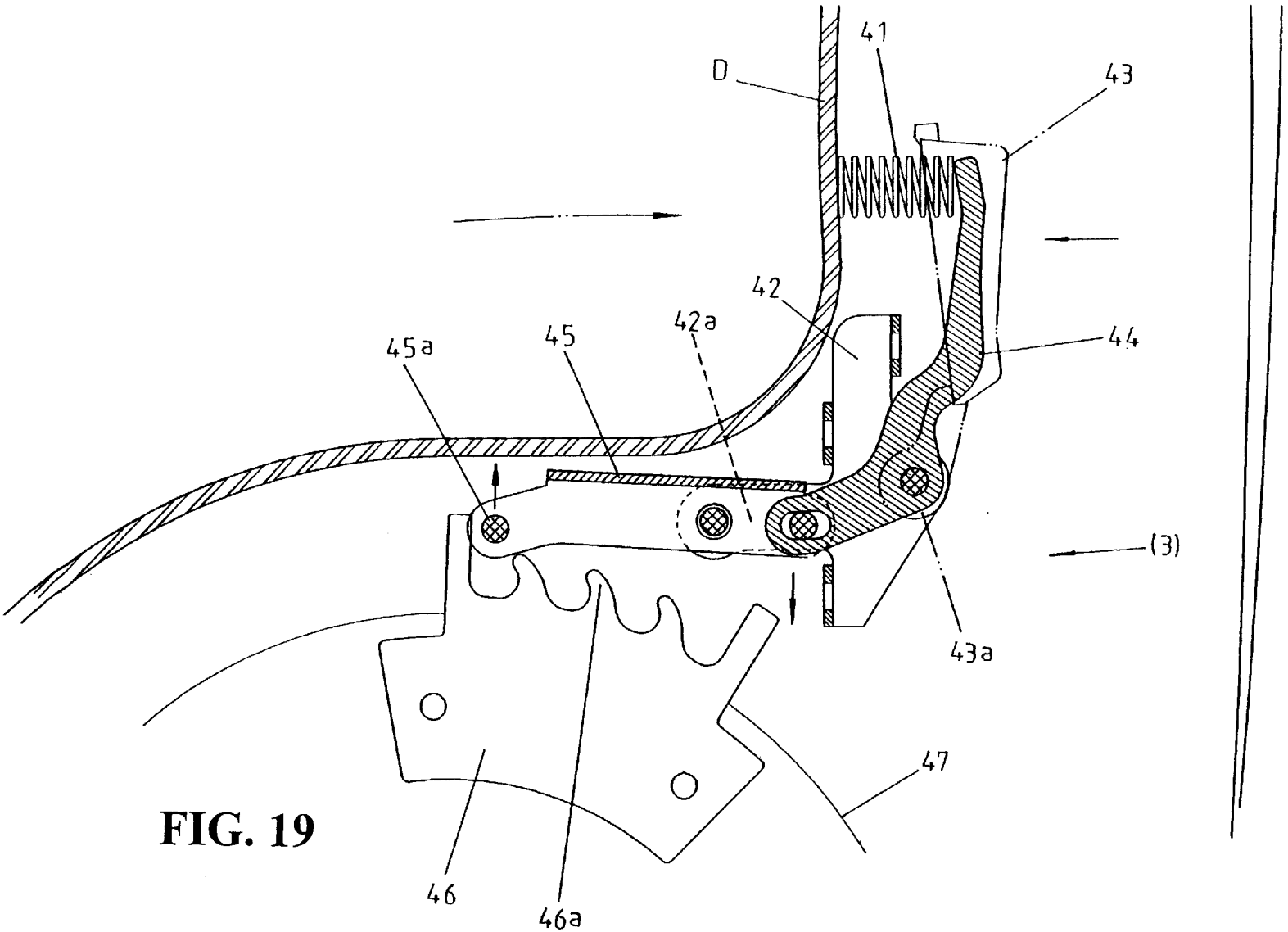
FIG. 19 is a schematic view showing the disengagement of the seat adjusting device with respect to FIG. 18.

With reference to FIGS. 17 to 19, the seat adjusting device (3) is mounted between the seat (D) and the leg (B) and comprises a bracket (47) peripherally defining therein a cutout (47*a*), a plate (46) received in the cutout (47*a*) and having a plurality of troughs (46*a*) defined in the periphery thereof, a substantially U-shaped link (45) having a pair of legs (45*a*) extending out therefrom and each provided with a through hole (45*b*) defined in a distal end thereof and a sleeve (45*c*) received between the pair of legs (45*a*) and selectively received in one of the troughs (46*a*), a connector (42) having a plurality of extensions (42*a*) and one of which is securely connected with the body of the link (45), an elongate link (44) one end of which is connected with one end of the connector (42) with a base (43*a*) of a press (43) and the other end of which is connected with another end of the connector (45). As shown in FIG. 18, one distal end of the elongate link (44) abuts one end of a spring (41). When the press (43) is pressed, the spring (41) is compressed, the elongate link (44) is lifted. When the elongate link (44) is lifted upward, the link (45) pivots due to the extension (42*a*). Simultaneously, the sleeve (45*a*) disengages with the plate (46) from one of the troughs (46*a*). After the sleeve (45*a*) disengages from the plate (46), the user is able to change the angle of the seat (D) with respect to the foot (B). After the adjustment, the user releases the press (43), such that the recoil force of the spring (41) will allow the press (43) to return to its original position and the sleeve (45*a*) is once again received in one of the troughs (46*a*).

Figure 20:
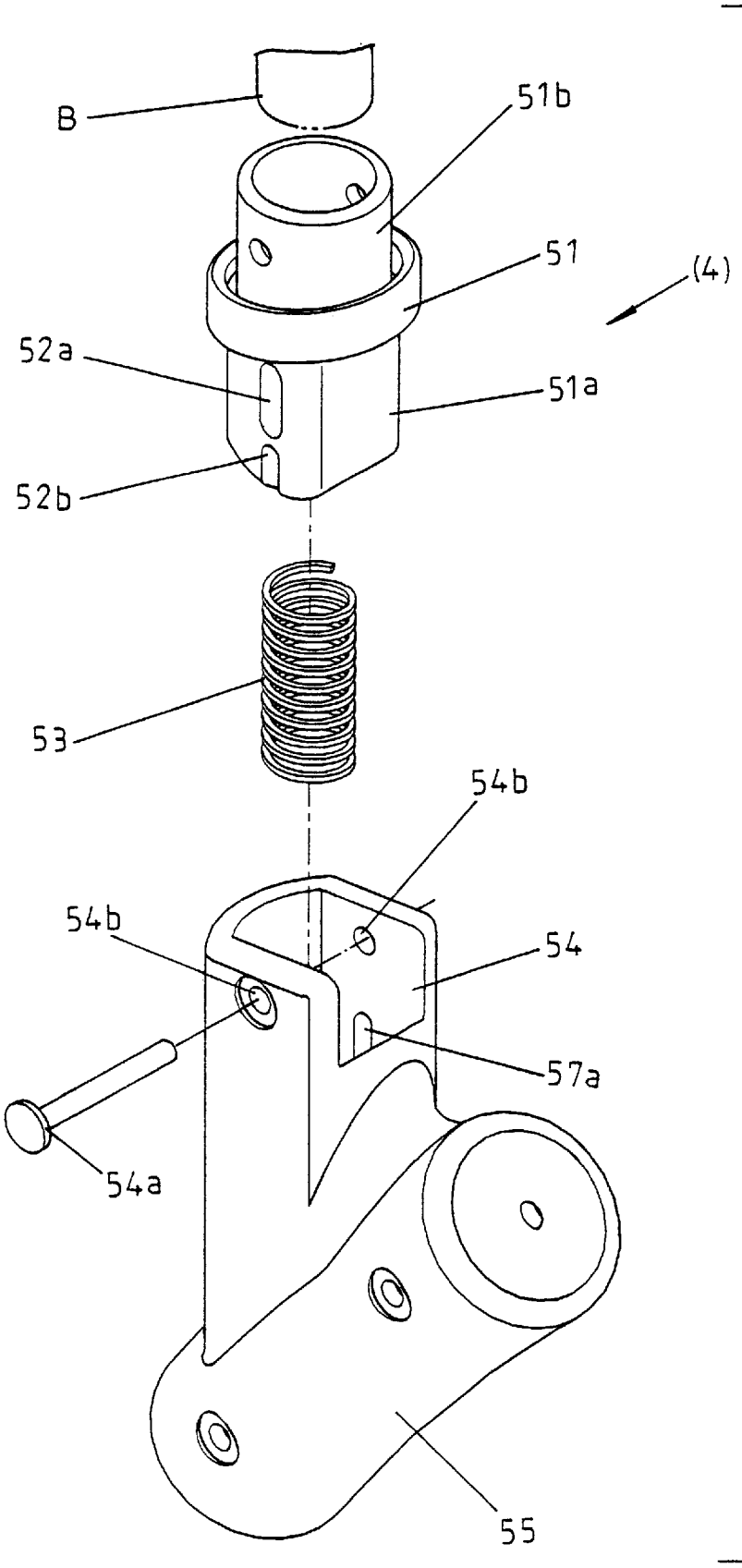
FIG. 20 is an exploded view showing parts of a second locking device of the invention.
Figure 21:
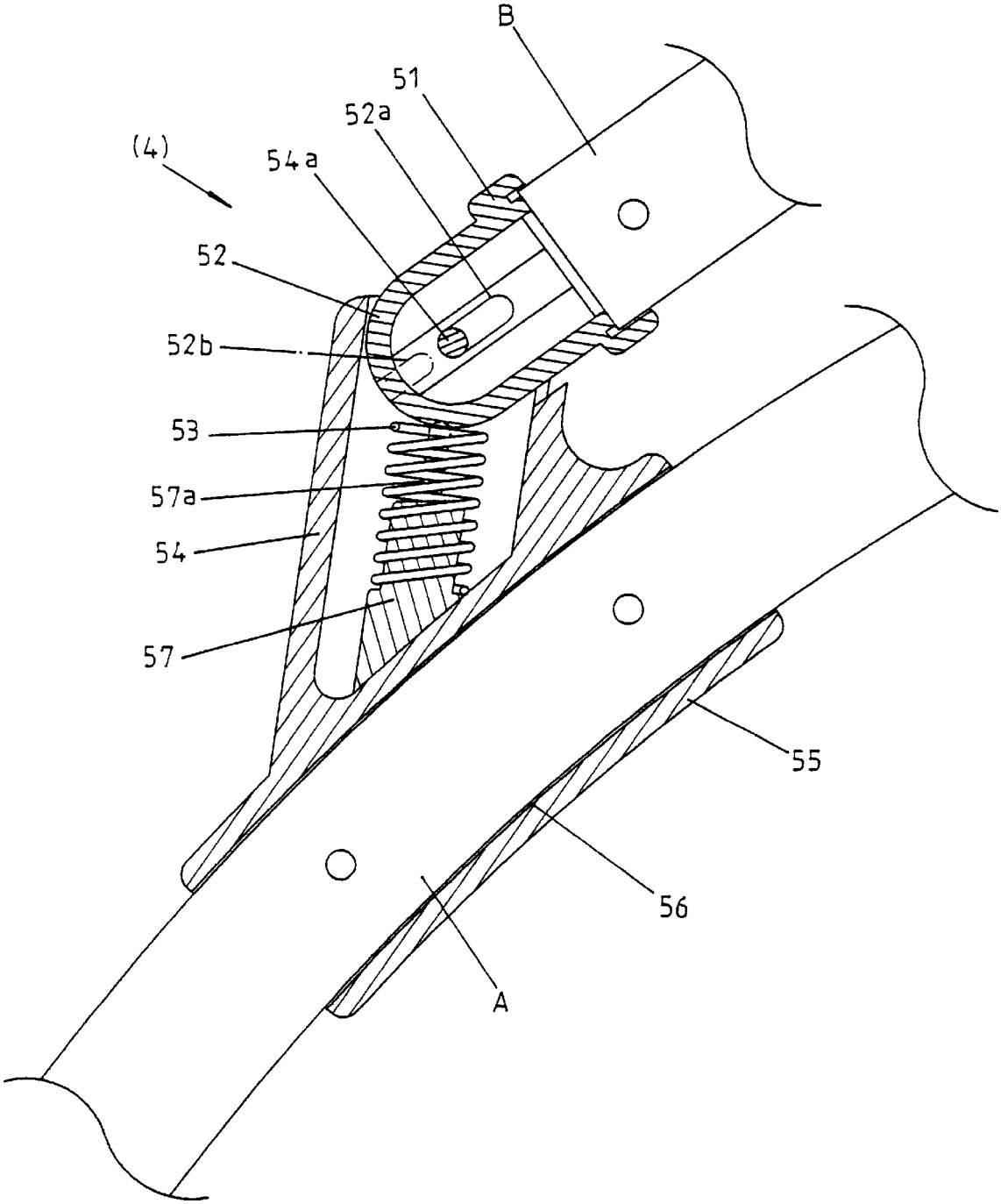
FIG. 21 is a schematic view of the second locking device before being locked.
Figure 22:
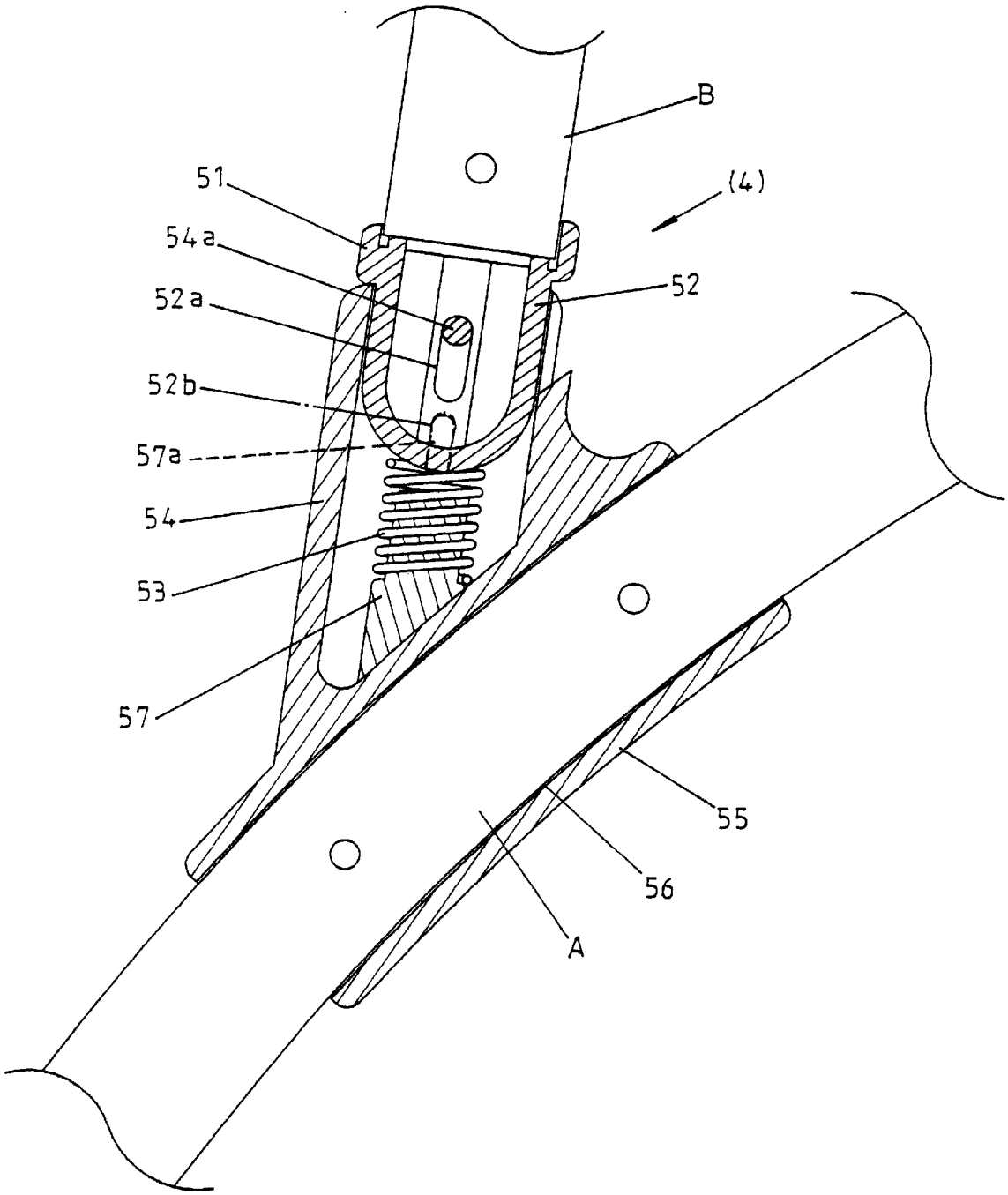
FIG. 22 is a schematic view showing the locked state of the second locking device.

Referring to FIGS. 20 o 22, a second locking device (2) is shown. The second locking device (2) is mounted at the joint of leg (A) and leg (B) and comprises a third tube (55) configured to receive the leg (A)jkhj therethrough and having a hollow support (54) integrally formed therewith. The hollow support (54) has a protrusion (57) (as shown in FIG. 21) internally and centrally formed therein. The hollow support (54) further has a pole (57*a*) formed on the inner face thereof, a spring (53) mounted around the protrusion (57), an insert (51) partially received in the hollow support (54) and having a lower tube (51*a*) integrally formed therewith and an upper tube (51*b*) configured to receive a distal end of the leg (B). The lower tube (51*a*) has a first hole (52*a*) defined in the bottom thereof and an elongate second hole (52*b*). The first hole (52*a*) is aligned with a pair of through holes (54*b*) so that a pin (54*a*) is able to be extend through the through holes (54*b*) and the first hole (52*a*) of the lower tube (51*a*), as shown in FIG. 21. Before a baby sits in the seat (D), the spring (53) will urge against the bottom of the lower tube (51*a*) so as to allow the insert to be pivotal with respect to the hollow support (54). After the baby sits in the seat (D), the weight of the baby will push down the seat (D) and to allow the pole (57*a*) to be received in the second hole (52*b*) to limit the pivotal movement of the insert (51) so as to secure the safety of the baby. With the arrangement, the baby can be put into the seat (D) at a pivotal range of the insert (51), such that parents do not have to always put the baby into the seat (D) at a fixed angle.

Figure 23:
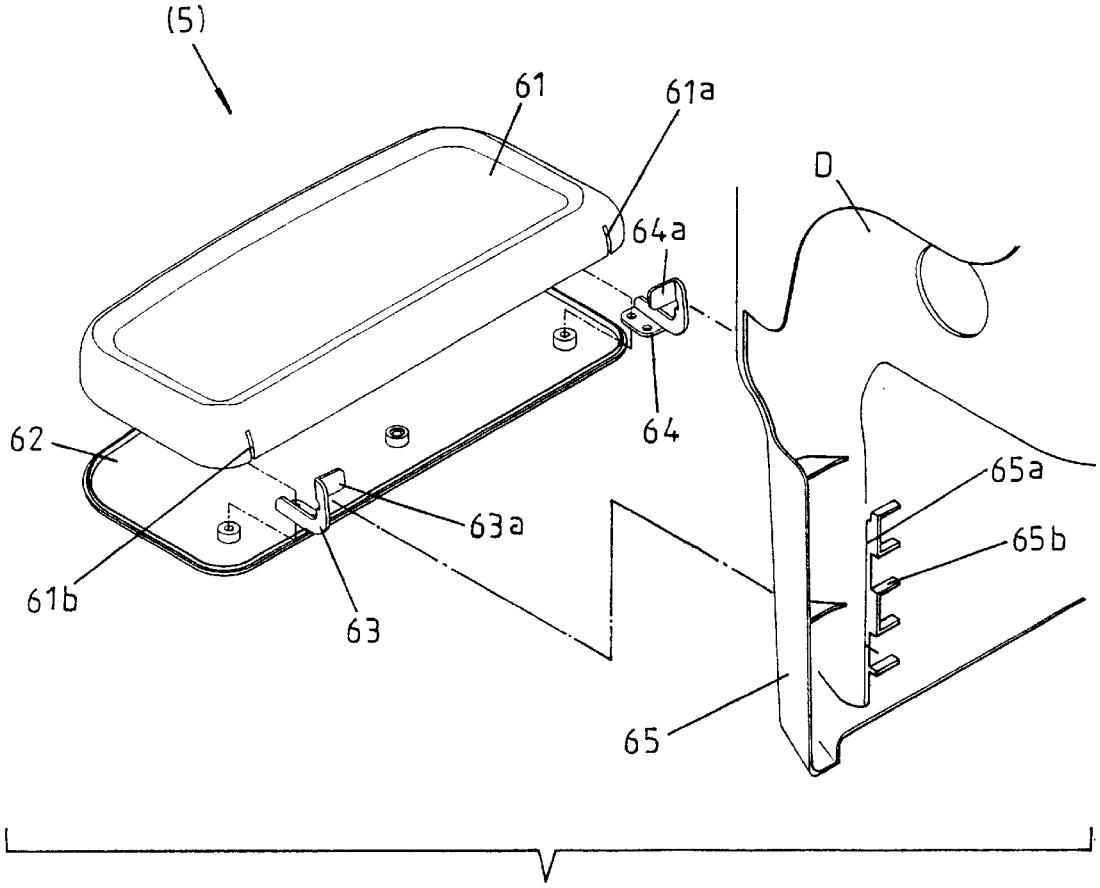
FIG. 23 is an exploded view showing parts of a foot rest.
Figure 24:
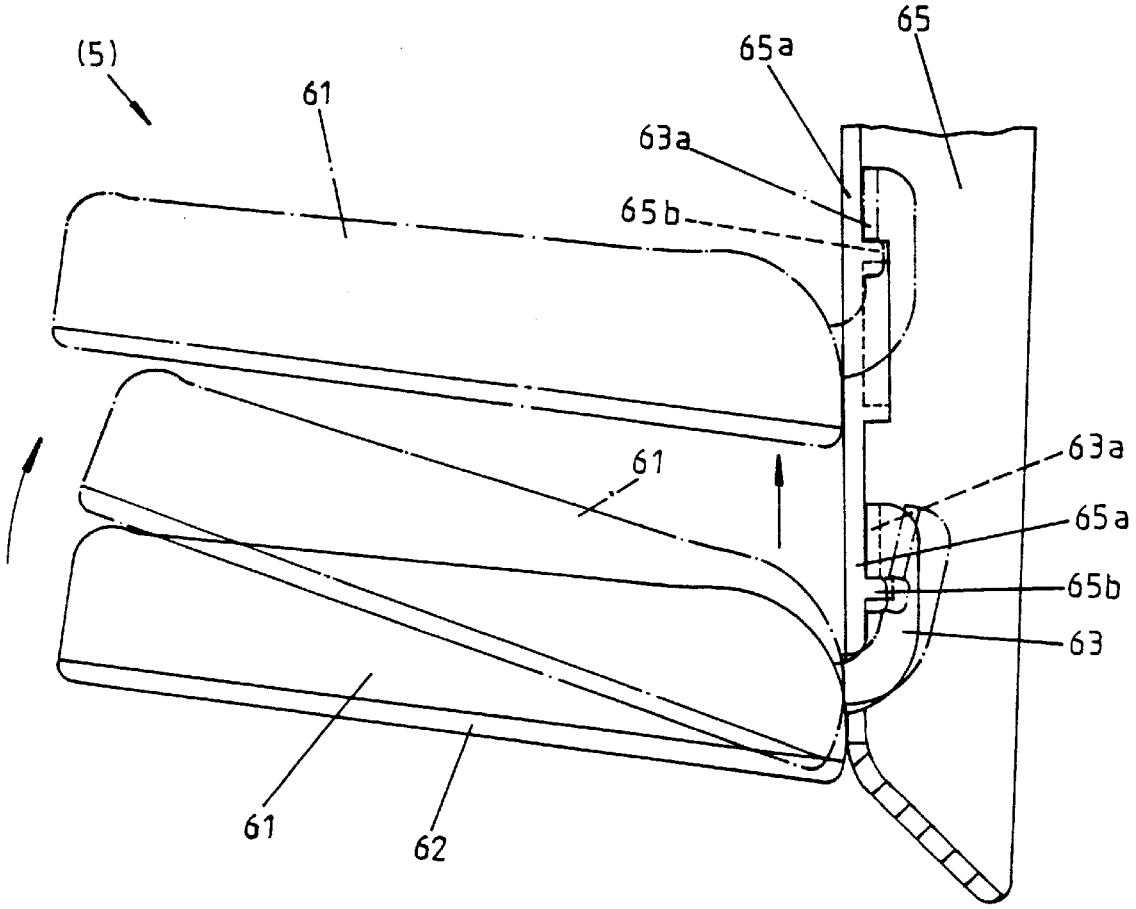
FIG. 24 is a schematic view showing the engagement of the foot rest with the chair.

With reference to FIG. 23, the foot rest (5) comprises two plates (65) each provided with a plurality of slots (65*a*) each with a pair of opposite lips (65*b*). An upper plate (61) has two slits (61*a*) and (61*b*) respectively defined in the outer face thereof. A lower plate (62) has two substantially L-shaped hooks (63) securely mounted on the face thereof and having a head (63*a*) formed on the free end of the hook (63). When in assembly, the L-shaped hooks (63) are inserted into the slits (61*b*) to engage the upper plate (61) and the lower plate (62) and the head (63*a*) is received in the aligned slots (65*a*), such that the assembly of the foot rest (5) is accomplished. When the user tries to adjust the height of the foot rest (5) with respect to the seat (D), the user only has to pull out the heads (63*a*) from the slots (65*a*) and relocate the heads (63*a*) into another aligned slots (65*a*) to complete the adjustment, as shown in FIG. 24.

Figure 2:
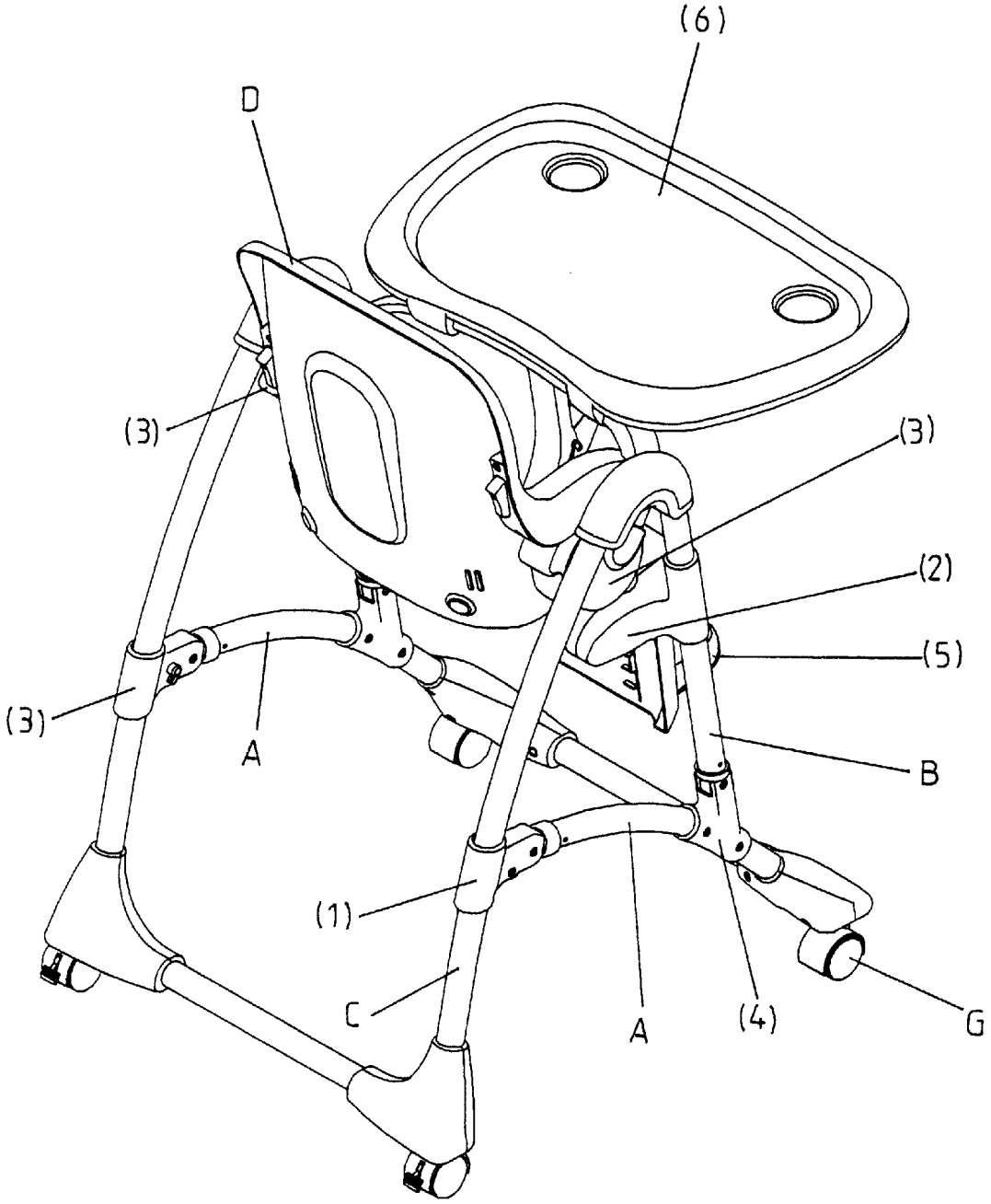
FIG. 2 is a perspective view showing the rear side of the adjustable chair constructed in accordance with the present invention.
Figure 25:
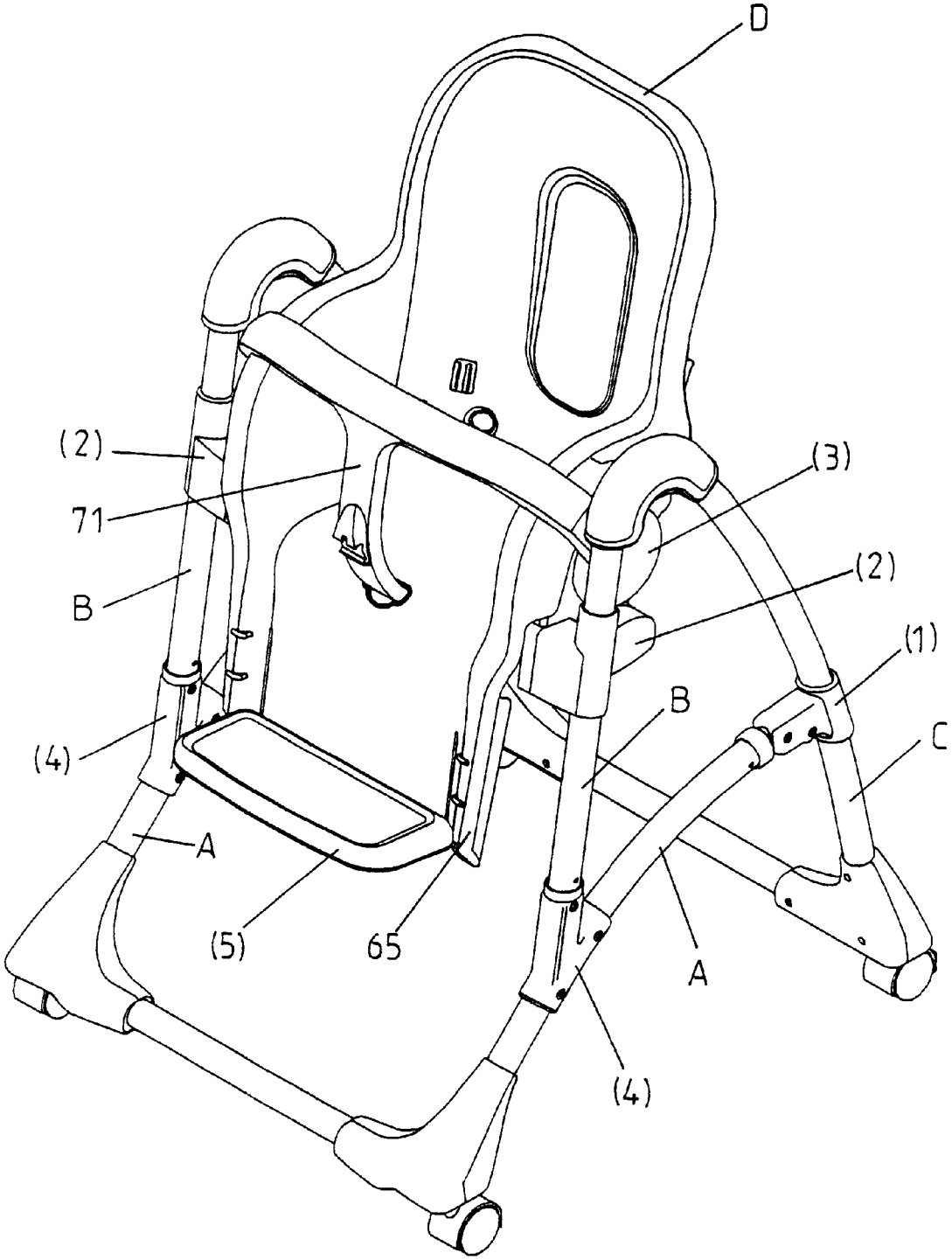
FIG. 25 is a perspective view showing the adjustable chair of the invention without a plate mounted thereon.

With reference to FIG. 25, between the foot rest (5) and the seat (D), a leg (71) is securely mounted on a face of the seat (D), such that a desk (6), as shown in FIGS. 1 and 2, is able to be attached to the leg (71). Since the attachment of the desk (6) to the leg (71) is conventional in the art, detailed description thereof is thus omitted.

It is to be noted from the description set forth, the adjustable baby chair of the invention is able to have its legs (A,C) pivoted with respect to each other by means of the first locking device (1). With the help of the height adjusting device (2), the height of the seat (D) can be adjusted in relation to the legs mechanism. With the provision of the seat adjusting device, the angle of the seat (D) is able to be adjusted to save a lot of trouble of the parents. With the structure of the second locking device (4), the seat (D) can be securely fixed after the baby sits in the seat (D). With the adjustability of the foot rest (5), the chair of the invention is suitable to a growing baby at a certain range of height.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In an adjustable chair having a seat (D), a mechanism composed of two pairs of feet, each pair being oppositely mounted on sides of the chair having three legs (A,B,C), a foot rest (5), a plate (6) and rollers (G) rotatably mounted on a joint between leg (A) and leg (C), wherein the leg (A) and leg (C) are substantially curved and the leg (B) is substantially straight, the leg (A) and the leg (C) being able to be securely connected with each other and the two ends of leg (B) being mounted on the joint of leg (A) and leg (C) and a mediate portion of leg (A), respectively, and a first locking device (1) mounted on the joint between the leg (A) and the leg (C) so as to allow the leg (A) and the leg (C) to fold with respect to each other, wherein the improvement comprises:

a first tubular connector (10) provided with a first tube (11) to receive the leg (C) therein, an L-shaped side cover (12) extending from one side of the first tube (11) and having an elongate rod (13) traversely extending from an inside therefrom, an annular flange (12*a*) and a first hole (12*b*) formed in the side cover (12), a spring (14) mounted around the elongate rod (13), a hollow press (15) configured to receive the spring (14) therein and having a button (15*a*) movable with respect to the body of the press (15) and an extension (15*b*) formed on a side of the body of the press (15), a connector (16) having a receiving hole (16*a*) defined to receive the button (15*a*) therethrough after the spring (14) is received in the button (15*a*), a pole (16*d*) extending outside therefrom and having a through hole (16*b*) defined therethrough and a connecting hole (16*c*) defined to correspond to the first hole (12*b*) of the first tubular connector (10) so as to securely connect the connector (16) with the first tubular connector (10) with a locking device, and a connecting member (17) having a second hole (17*a*) defined to allow the pole (16*d*) to extend therethrough, a first tube (17*b*) with a second tube (17*c*) respectively and concentrically formed therewith so that one end of the leg (A) is able to be received between a gap between the first and the second tubes (17*b*, 17*c*), a first cutout (17*d*) and a second cutout (17*e*) respectively and peripherally defined in an outer face defining the second hole (17*a*), and a protrusion (17*f*) formed between the first and the second cutouts (17*d*, 17*e*) and a space (17*g*).

2. The chair as claimed in claim 1, further comprising a seat adjusting device (2) mounted at a joint of the seat (D) and leg (B) and having a housing (23) provided with a second tube (21) integrally formed on a side of the housing (23) for receiving a distal end of the leg (B) therein, a hollow extension (24) and a pole (25), a linking member (28) having a plurality of leaves (281) spaced apart from each other and each provided with a concentric hole (28*a*) aligned with one another for receiving a first shaft (29) therein and a through hole (28*b*) defined to receive the pole (25) therein so that the linking member (28) is able to pivot in relation to the housing, a substantially S-shaped linkage (26) having an aperture (26*a*) defined to receive a second shaft (27) therein and an elongate hole (26*b*) defined to receive the first shaft (29) therethrough before the first shaft (29) extends through the concentric holes (28*a*) such that the linkage (26) is able to pivot with respect to the linking member (28), a substantially U-shaped member (30) received in the housing (23) and provided with a first opening (30*a*) defined in a base of the U-shaped member (30), a pair of second openings (30*b*) defined in opposite faces of the U-shaped member (30), a pair of first holes (30*d*1) defined in the opposite faces of the U-shaped member (30) and a pair of second holes (30*e*1) defined in the opposite faces of the U-shaped member (30), a first linking member having a base (31), a friction face (32) provided on one side of the base (31) and corresponding to the first opening (30*a*), a seat (33) mounted on an opposite side of the base (31) with respect to the friction face (32) and provided with an indentation (33*a*) defined therein and an extension rod (34) extending outward from the seat (33) and having a hole (34*a*) defined in a mediate portion of the rod (34) and a traverse rod (35) formed on the distal end of the extension rod (34).

3. The chair as claimed in claim 1 further comprising a seat adjusting device (3) mounted between the seat (D) and the leg (B) and comprising a bracket (47) peripherally defining therein a cutout (47*a*), a plate (46) received in the cutout (47*a*) and having a plurality of troughs (46*a*) defined in a periphery thereof, a substantially U-shaped link (45) having a pair of legs extending out therefrom and each provided with a through hole (45*b*) defined in a distal end thereof and a sleeve (45*a*) received between the pair of legs and selectively received in one of the troughs (46*a*), a connector (42) having a plurality of extensions (42*a*) and one of which is securely connected with the body of the link (45), an elongate link (44) one end of which is connected with one end of the connector (42) with a base (43*a*) of a press (43) and the other end of which is connected with another end of the link (45), wherein one distal end of the elongate link (44) abuts one end of a spring (41) so as that when the spring (41) is compressed, the elongate link (44) is lifted and the elongate link (44) is lifted upward, wherein the link (45) pivots due to the extension (42*a*) and wherein the sleeve (45*a*) disengages with the plate (46) from one of the troughs (46*a*), and wherein upon releasing the press (43), the recoil force of the spring (41) will allow the press (43) to return to its original position so that the sleeve (45*a*) is once again received in one of the troughs (46*a*).

4. The chair as claimed in claim 1 further comprising a second locking device (2) mounted at a joint of leg (A) and leg (B) and including a third tube (55) configured to receive the leg (A) therethrough and having a hollow support (54) integrally formed therewith, wherein the hollow support (54) has a protrusion (57) internally and centrally formed therein, a pole (57*a*) formed on the inner face thereof, a spring (53) mounted around the protrusion (57), an insert (51) partially received in the hollow support (54) and a lower tube (51*a*) integrally formed therewith and an upper tube (51*b*) configured to receive a distal end of the leg (B), wherein the lower tube (51*a*) has a first hole (52*a*) defined in the bottom thereof and an elongate second hole (52*b*), the first hole (52*a*) being aligned with a pair of through holes (54*b*) so that a pin (54*a*) is able to be extended through the through holes (54*b*) and the first hole (52*a*) of the lower tube (51*a*), wherein the spring (53) urges against the bottom of the lower tube (51*a*) so as to allow the insert (51) to be pivoted with respect to the hollow support (54), whereby after a baby sits in the seat (D), the weight of the baby will push down the seat (D) and to allow the pole (57*a*) to be received in the second hole (52*b*) to limit the pivotal movement of the insert (51) and secure the safety of the baby.

5. The chair as claimed in claim 1 wherein the foot rest (5) includes two plates (65) each provided with a plurality of slots (65*a*) each with a pair of opposite lips (65*b*), an upper plate (61) having two slits (61*a*) and (61*b*) respectively defined in the outer face thereof, a lower plate (62) having two substantially L-shaped hooks (63) securely mounted on the face thereof and a head (63*a*) formed on a free end of the hook (63), wherein, the L-shaped hooks (63) are inserted into the slits (61*b*) to engage the upper plate (61) and the lower plate (62) and the head (63*a*) is received in aligned slots (65*a*), such that the assembly of the foot rest (5) is accomplished, wherein the heads (63*a*) are able to be disengaged from the slots (65*a*) and relocate the heads (63*a*) into other aligned slots (65*a*) to complete an adjustment.

6. In an adjustable chair having a seat (D), a mechanism composed of two pairs of feet, each pair being oppositely mounted on sides of the chair having three legs (A,B,C), a foot rest (5), a plate (6) and rollers (G) rotatably mounted on a joint between leg (A) and leg (C), wherein the leg (A) and leg (C) are substantially curved and the leg (B) is substantially straight, the leg (A) and the leg (C) being able to be securely connected with each other and the two ends of leg (B) being mounted on the joint of leg (A) and leg (C) and a mediate portion of leg (A) respectively and a first locking device (1) mounted on the joint between the leg (A) and the leg (C) so as to allow the leg (A) and the leg (C) to fold with respect to each other, wherein the improvement comprises:

a first tubular connector (10) provided with a first tube (11) to receive the leg (C) therein, an L-shaped side cover (12) extending from one side of the first tube (11) and having an elongate rod (13) traversely extending from an inside therefrom, an annular flange (12*a*) and a first hole (12*b*) formed in the side cover (12), a spring (14) mounted around the elongate rod (13), a hollow press (15) configured to receive the spring (14) therein and having a button (15*a*) movable with respect to the body of the press (15) and an extension (15*b*) formed on a side of the body of the press (15), a connector (16) having a receiving hole (16*a*) defined to receive the button (15*a*) therethrough after the spring (14) is received in the button (15*a*), a pole (16*d*) extending outside therefrom and having a through hole (16*b*) defined therethrough and a connecting hole (16*c*) defined to correspond to the first hole (12*b*) of the first tubular connector (10) so as to securely connect the connector (16) with the first tubular connector (10) with a locking device, and a connecting member (17) having a second hole (17*a*) defined to allow the pole (16*d*) to extend therethrough, a first tube (17*b*) with a second tube (17*c*) respectively and concentrically formed therewith so that one end of the leg (A) is able to be received between a gap between the first and the second tubes (17*b*, 17*c*), a first cutout (17*d*) and a second cutout (17*e*) respectively and peripherally defined in an outer face defining the second hole (17*a*), and a protrusion (17*f*) formed between the first and the second cutouts (17*d*, 17*e*) and a space (17*g*);

a seat adjusting device (2) mounted at a joint of the seat (D) and leg (B) and having a housing (23) provided with a second tube (21) integrally formed on a side of the housing (23) for receiving a distal end of the leg (B) therein, a hollow extension (24) and a pole (25), a linking member (28) having a plurality of leaves (281) spaced apart from each other and each provided with a concentric hole (28*a*) aligned with one another for receiving a first shaft (29) therein and a through hole (28*b*) defined to receive the pole (25) therein so that the linking member (28) is able to pivot in relation to the housing, a substantially S-shaped linkage (26) having an aperture (26*a*) defined to receive a second shaft (27) therein and an elongate hole (26*b*) defined to receive the first shaft (29) therethrough before the first shaft (29) extends through the entire concentric holes (28*a*) such that the linkage (26) is able to pivot with respect to the linking member (28), a substantially U-shaped member (30) received in the housing (23) and provided with a first opening (30*a*) defined in a base of the U-shaped member (30), a pair of second openings (30*b*) defined in opposite faces of the U-shaped member (30), a pair of first holes (30*d*1) defined in the opposite faces of the U-shaped member (30) and a pair of second holes (30*e*1) defined in the opposite faces of the U-shaped member (30), a first linking member having a base (31), a friction face (32) provided on one side of the base (31) and corresponding to the first opening (30*a*), a seat (33) mounted on an opposite side of the base (31) with respect to the friction face (32) and provided with an indentation (33*a*) defined therein and an extension rod (34) extending outward from the seat (33) and having a hole (34*a*) defined in a mediate portion of the rod (34) and a traverse rod (35) formed on the distal end of the extension rod (34);

a seat adjusting device (3) mounted between the seat (D) and the leg (B) and comprising a bracket (47) peripherally defining therein a cutout (47*a*), a plate (46) received in the cutout (47*a*) and having a plurality of troughs (46*a*) defined in a periphery thereof, a substantially U-shaped link (45) having a pair of legs extending out therefrom and each provided with a through hole (45*b*) defined in a distal end thereof and a sleeve (45*a*) received between the pair of legs and selectively received in one of the troughs (46*a*), a connector (42) having a plurality of extensions (42*a*), one of which is securely connected with the body of the link (45), an elongate link (44) one end of which is connected with one end of the connector (42) with a base (43*a*) of a press (43) and the other end of which is connected with another end of the link (45), wherein one distal end of the elongate link (44) abuts one end of a spring (41) so as that when the spring (41) is compressed, the elongate link (44) is lifted and the elongate link (44) is lifted upward, wherein the link (45) pivots due to the extension (42*a*) and wherein the sleeve (45*a*) disengages with the plate (46) from one of the troughs (46*a*), and wherein releasing the press (43), the recoil force of the spring (41) will allow the press (43) to return to its original position so that the sleeve (45*a*) is once again received in one of the troughs (46*a*);

a second locking device (2) mounted at a joint of leg (A) and leg (B) and including a third tube (55) configured to receive the leg (A) therethrough and having a hollow support (54) integrally formed therewith, wherein the hollow support (54) has a protrusion (57) internally and centrally formed therein, a pole (57*a*) formed on the inner face thereof, a spring (53) mounted around the protrusion (57), an insert (51) partially received in the hollow support (54) and a lower tube (51*a*) integrally formed therewith and an upper tube (51*b*) configured to receive a distal end of the leg (B), wherein the lower tube (51*a*) has a first hole (52*a*) defined in the bottom thereof and an elongate second hole (52*b*), the first hole (52*a*) being aligned with a pair of through holes (54*b*) so that a pin (54*a*) is able to be extended through the through holes (54*b*) and the first hole (52*a*) of the lower tube (51*a*), wherein the spring (53) urges against the bottom of the lower tube (51*a*) so as to allow the insert (51) to be pivoted with respect to the hollow support (54), whereby after a baby sits in the seat (D), the weight of the baby will push down the seat (D) and to allow the pole (57*a*) to be received in the second hole (52*b*) to limit the pivotal movement of the insert (51) and secure the safety of the baby; and a foot rest (5) including two plates (65) each provided with a plurality of slots (65*a*) each with a pair of opposite lips (65*b*), an upper plate (61) having two slits (61*a*) and (61*b*) respectively defined in the outer face thereof, a lower plate (62) having two substantially L-shaped hooks (63) securely mounted on the face thereof and a head (63*a*) formed on a free end of the hook (63), wherein, the L-shaped hooks (63) are inserted into the slits (61*b*) to engage the upper plate (61) and the lower plate (62) and the head (63*a*) is received in aligned slots (65*a*), such that the assembly of the foot rest (5) is accomplished, wherein the heads (63*a*) are able to be disengaged from the slots (65*a*) and relocate the heads (63*a*) into other aligned slots (65*a*) to complete an adjustment.

* * * * *